US005085971A

United States Patent [19]

Katoh et al.

[11] Patent Number: 5,085,971

[45] Date of Patent: Feb. 4, 1992

[54] SILVER HALIDE PHOTOGRAPHIC MATERIALS

[75] Inventors: Kazunobu Katoh; Morio Yagihara, both of Kanagawa, Japan

[73] Assignee: Fuji Photo Film Co., Ltd., Kanagawa, Japan

[21] Appl. No.: 523,690

[22] Filed: May 15, 1990

[30] Foreign Application Priority Data

May 16, 1989 [JP] Japan ..... 1-122346

[51] Int. Cl.[5] ..... G03C 1/06

[52] U.S. Cl. ..... 430/264; 430/544; 430/546; 430/572; 430/598; 430/957

[58] Field of Search ..... 430/222, 223, 264, 572, 430/566, 598, 957, 544, 546

[56] References Cited

U.S. PATENT DOCUMENTS 4,368,258 1/1983 Fujiwhara ..... 430/493
4,388,403 6/1983 Helling et al. ..... 430/546
4,490,461 12/1984 Webb et al. ..... 430/510
4,684,604 8/1987 Harder ..... 430/375
4,923,787 5/1990 Harder ..... 430/489

FOREIGN PATENT DOCUMENTS 62-245263 10/1987 Japan .
63-046450 2/1988 Japan .

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A silver halide photographic material comprising a support having thereon a hydrophilic colloid layer which contains gelatin and wherein the hydrophilic colloid layer contains fine polymer particles which contains a redox compound which is capable of releasing a development inhibitor by oxidation, and a hydrazine compound, which is not the same as the redox compound, is contained in the hydrophilic colloid layer and/or in another hydrophilic colloid layer.

9 Claims, 1 Drawing Sheet

SILVER HALIDE PHOTOGRAPHIC MATERIALS

FIELD OF THE INVENTION

This invention concerns silver halide photographic materials and a method for the formation of ultra-high contrast negative images in which these materials are used. More precisely it concerns ultra-high contrast negative photographic photosensitive materials suitable for use in photomechanical plate making processes.

BACKGROUND OF THE INVENTION

Photographic materials capable of giving high quality original reproduction, stable development baths and simplified replenishment system are required in the field of photomechanical plate making for dealing with the wide variety of diversified and complicated printing forms.

Original documents to be subjected to line work camera processes in particular comprise phototypeset letters, hand written letters, illustrations and halftone dot image photographs. Hence, the original documents for these processes include a mixture of images having different densities and line widths. There is therefore a demand for photomechanical process cameras, photographic materials and image forming methods capable of accurately copying these original documents. On the other hand, enlargement (spread) or reduction (choke) of dot image photographs is widely used in plate making for catalogues and posters and in plate making where screen dots are enlarged In such processes, the number of lines becomes coarser and blurred dots are photographed. With reduction the number of lines per inch is greater than on the original document and finer dots are photographed. Hence, there is a demand for a method of forming images which has a wider latitude for maintaining the reproducibility of halftone dot image gradation.

Halogen lamps or xenon lamps are used as light sources for photomechanical process cameras. Photographic materials are normally ortho sensitized to increase photographic sensitivity to these light sources. However, ortho sensitized photographic materials are greatly affected by chromatic aberration of lenses which is likely to result in deterioration of picture quality. This deterioration is more pronounced with xenon lamp light sources.

Known systems addressing the demand for a wider latitude include those in which line images or halftone dot images containing a clear distinction between image parts and non-image parts and ficturing high contrast and high black densities are obtained by processing lith type silver halide photosensitive materials comprising silver chlorobromides (in which the silver chloride content is at least 50%) in hydroquinone developers having a very low effective concentration of sulfite ion (normally less than 0.1 mol/liter). However, with these methods the developer is very unstable to aerial oxidation because of its low sulfite concentration, and various endeavors and devices have been used to maintain a stable bath activity. At the present time, however, processing is very slow and operational efficiency is low.

Consequently, a demand has arisen for an image forming system in which the instability of image formation with development methods such as those mentioned above (lith development systems) are overcome, with which development is carried out in processing baths having good storage stability, and with which ultra-high contrast photographic characteristics can be realized. The systems in which ultra-high contrast images having a gamma value exceeding 10 are formed by processing surface latent image type silver halide photographic materials to which specified acylhydrazine compounds have been added in development baths of a pH from 11.0 to 12.3 and containing at least 0.15 mol/liter of sulfite preservative and which have good storage stability as suggested in U.S. Pat. Nos. 4,166,742, 4,168,977, 4,221,857, 4,224,401, 4,243,739, 4,272,606 and 4,311,781. A distinguishing feature of these novel image forming systems is that, silver iodobromides and silver chloroiodobromides can be used, whereas only silver chlorobromides which had a high silver chloride content could be used in the conventional ultra-high contrast image forming systems.

The above mentioned image forming systems provide excellent sharp screen dot quality, processing stability, processing speed and original reproduction properties. But systems which provide improved original reproduction properties have become desirable for dealing with the diversity of printed matter.

On the other hand, operating efficiency is improved when plate assembly and dot-to-dot processes are carried out in a light environment. Consequently, development of photographic materials for plate making purposes which can be handled in environments known as light-rooms and the development of exposure printers has been conducted.

The photographic materials for use in a light-room described herein are photographic materials which can be used safely for long periods of time using light of a wavelength essentially greater than 400 nm, but which does not contain an ultraviolet component as a safelight.

The photographic materials for use in a light-room which can be used for plate assembly and dot-to-dot processes are photographic materials which are used to carry out negative image/positive image or positive image/positive image conversion, where developed and processed films on which letters and halftone dot images have been formed are used as originals, and a contact exposure is made with a dot-to-dot working photographic material. However, it is desirable (1) that the material performs so that halftone dot images, line images, and letter images may be negative image/positive image converted in accordance with the halftone dot areas and the line width or with letter image width, and (2) that the material performs so that the tone control of the halftone dot images and the line width control of the letter line images is possible. Photographic materials for light-room dot-to-dot work have been supplied in response to these requirements.

However, in the advanced image conversion operation known as super-imposed letter image formation by dot-to-dot work there is the disadvantage that, in comparison with the methods in which dark-room dot-to-dot work is carried out with conventional dark-room dot-to-dot photosensitive materials, there is an inevitable deterioration in the quality of the super-imposed letter image when the light-room dot-to-dot process is used with existing light-room photosensitive materials.

The method of super-imposed letter image formation by dot-to-dot work is described in greater detail below in connection with the sole Figure of this specification. As shown in the Figure, transparent or translucent supports (a) and (c) (generally, polyethylene terephthalate film having a thickness of approximately 100 microns is used) are attached to a letter or line image-containing film (line original) (b) and a halftone dot image-containing film (halftone original) (d), respectively, to form a combined original, and a dot-to-dot working photographic material (e) is brought into contact with the halftone original (d) so that the emulsion surface of the material (e) faces and contacts the halftone image surface of the original (d). Then the material is exposed to light through the combined original by contact exposure.

After exposure, the material is subjected to development processing, and the transparent parts of the line image are formed in a halftone dot image.

The important aspect of this method of forming a super-imposed letter image is that it is ideal for carrying out negative image/positive image conversion in accordance with the halftone dot area and the image width of the halftone dot original and the line original, respectively. However, as shown in the Figure, the halftone dot original is in direct contact with the emulsion surface of the dot-to-dot photographic material when the exposure is made. On the other hand, the line original is exposed to the dot-to-dot photographic material through the intervening support (c) and the halftone dot original (d).

Consequently, when an exposure which provides faithful negative image/positive image conversion of the halftone dot original is given, the image width in the transparent parts of the line image is inevitably reduced since the line original is exposed with blurring through the support (c) and the halftone dot original (d). This is the cause of the inevitable deterioration in quality of the super-imposed letter image.

Systems in which hydrazines are used to overcome the problem described above are disclosed in JP-A-62-80640, JP-A-62-235938, JP-A-62-235939, JP-A-63-104046, JP-A-63-103235, JP-A-63-2906031, JP-A-63-314541 and JP-A-64-13545 (the term "JP-A" as used herein signifies an "unexamined published Japanese patent application"). But these systems cannot be said to be satisfactory and further improvement is desirable.

The use of redox compounds which can release development inhibitors on oxidation is disclosed in JP-A-61-213847, U.S. Pat. No. 4,684,604, JP-A-64-72140 and JP-A-64-72139.

However, various problems arise when these redox compounds are used in negative type ultra-high contrast photographic materials which contain hydrazine derivatives and so the potential of these redox compounds cannot be realized satisfactorily.

Specifically, there is a loss of contrast, and adequate improvement in original reproducibility is not attained.

SUMMARY OF THE INVENTION

One object of the present invention is to provide silver halide photographic materials for use in the field of photomechanical plate making with which excellent reproduction is obtained by photographing letter originals and halftone dot originals.

Another object of the invention is to provide dot-to-dot photographic materials which can be handled in environments known as light-rooms, which can be used in the field of photomechanical plate making and which provide excellent super-imposed letter image quality.

These and other objects of the present invention have been realized by means of a silver halide photographic material comprising a support having thereon a hydrophilic colloid layer which contains gelatin and fine polymer particles which contain a redox compound which releases a development inhibitor upon oxidation, and wherein a hydrazine compound, which is not the same as the redox compound, is included in the hydrophilic colloid layer and/or in another hydrophilic colloid layer.

The aforementioned redox compounds preferably contain a hydroquinone, a catechol, a naphthohydroquinone, an aminophenol, a pyrazolidone, a hydrazine, a hydroxylamine or a reductone as the redox group.

Preferred among these redox compounds are those which have a hydrazine as the redox group.

Moreover, the most desirable of the aforementioned redox compounds are those which can be represented by the general formula (I) indicated below:

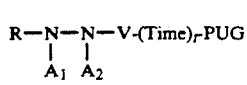

$$R-\underset{A_1}{N}-\underset{A_2}{N}-V\text{-}(Time)_t\text{-}PUG \quad (I)$$

wherein both $A_1$ and $A_2$ represent hydrogen atoms, or one represents a hydrogen atom and the other represents a substituted or unsubstituted alkylsulfonyl group, a substituted or unsubstituted arylsulfonyl group or

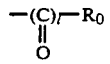

$$-\underset{\underset{O}{\|}}{(C)_l}-R_0$$

(where $R_0$ represents an alkyl group, an alkenyl group, an aryl group, an alkoxy group or an aryloxy group, and l represents 1 or 2). Time represents a divalent linking group, and t represents 0 or 1. PUG represents a development inhibitor. V represents a carbonyl group,

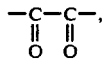

$$-\underset{\underset{O}{\|}}{C}-\underset{\underset{O}{\|}}{C}-,$$

a sulfonyl group, asulfoxy group

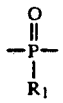

$$-\overset{\overset{O}{\|}}{\underset{\underset{R_1}{|}}{P}}-$$

(where $R_1$ represents an alkoxy group or an aryloxy group), an iminomethylene group or a thiocarbonyl group. R represents an aliphatic group, an aromatic group or a heterocyclic group.

BRIEF DESCRIPTION OF THE DRAWING

The-sole Figure shows an embodiment of formation of super-imposed letter images using a dot-to-dot work, where, the code letters used are defined below.

(a) is a transparent or translucent support, (b) is a line original (the black parts indicate line images), (c) is a transparent or translucent support, (d) is a halftone dot original (the black parts indicate the dots), and (e) is a dot-to-dot type photographic material (the shaded part indicates the photosensitive layer)

DETAILED DESCRIPTION OF THE INVENTION

Figure 1:
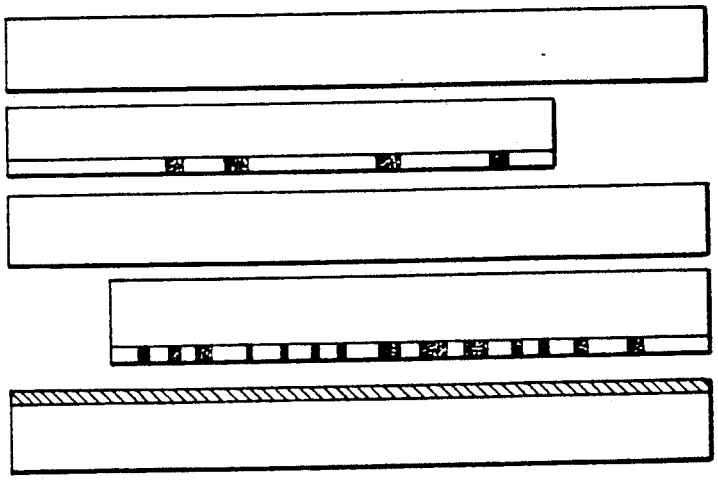

General formula [I] is described in detail below.

$A_1$ and $A_2$ in general formula (I) each represent a hydrogen atom, or one represents a hydrogen atom and the other represents a substituted or unsubstituted alkylsulfonyl group which has 20 or less carbon atoms, a substituted or unsubstituted arylsulfonyl group (preferably an unsubstituted phenylsulfonyl group or a substituted phenylsulfonyl groups in which the sum of the Hammett substituent constants is at least −0.5), or $$-\underset{\underset{O}{\|}}{(C)}R_0$$

(where $R_0$ is preferably a linear chain, branched or cyclic alkyl group which has 30 or less carbon atoms, an alkenyl group, an aryl group (preferably an unsubstituted phenyl group or a substituted phenyl group in which the sum of the Hammett substituent group constants is at least −0.5), an alkoxy group (for example, ethoxy), or an aryloxy group (which preferably has a single ring)). These groups may have substituent groups, examples of which are indicated below. These substituent groups may also be further substituted.

For example, the substituent groups may be an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo or carboxyl group, an aryloxycarbonyl group, an acyl group, an alkoxycarbonyl group, an acyloxy group, a carboxamido group, a sulfonamido group, a nitro group, an alkylthio group or an arylthio group. Specific examples of groups which can be represented by $A_1$ and $A_2$ have been disclosed in U.S. Pat. No. 4,478,928.

Furthermore, $A_1$ may be joined with —(Time)$_t$— as described hereinafter to form a ring.

$A_1$ and $A_2$ are most desirably hydrogen atoms.

Time represents a divalent linking group and has a timing adjustment function. Moreover, t represents 0 or 1, and when t=0, PUG is bonded directly to V.

The divalent linking groups represented by Time are groups which release PUG via a single or multi-stage reaction from the Time-PUG moiety which is released from the oxidized form of the redox nucleus.

Examples of divalent linking groups represented by Time include: (1) those which release a PUG by an intramolecular ring closing reaction of a p-nitrophenoxy compound as disclosed, for example, in U.S. Pat. No. 4,248,962 (JP-A-54-145135), (2) those which release a PUG by an intramolecular ring closing reaction after ring cleavage as disclosed, for example, in U.S. Pat. Nos. 4,310,612 (JP-A-55-53330) and 4,358,252, (3) those which release a PUG along with the formation of an acid anhydride by means of an intramolecular ring closing reaction of the carboxyl group of a monoester of succinic acid or a derivative thereof as disclosed, for example, in U.S. Pat. Nos. 4,330,617, 4,446,216 and 4,438,919, and JP-A-59-121328, (4) those in which a PUG is released with the formation of quinomonomethane or a derivative thereof by an electron transfer via the conjugated double bonds of an aryloxy group or a heterocyclic oxy group as disclosed, for example, in U.S. Pat. Nos. 4,409,323 and 4,421,845, *Research Disclosure,* No. 21228 (December, 1981), U.S. Pat. No. 4,416,977 (JP-A-57-135944), JP-A-58-209736 and JP-A-58-209738, (5) those which release a PUG from the γ-position of an enamine by electron transfer in a part of a nitrogen containing heterocyclic ring which has an enamine structure as disclosed, for example, in U.S. Pat. No. 4,420,554 (JP-A-57-136640), JP-A-57-135945, JP-A-57-188035, JP-A-58-98728 and JP-A-58-209737, (6) those which release a PUG by an intramolecular ring closing reaction of an oxy group which is formed by electron transfer to a carbonyl group which is conjugated with the nitrogen atom of a nitrogen containing heterocyclic ring as disclosed in JP-A-57-56837, (7) those which release a PUG with the formation of an aldehyde as disclosed, for example, in U.S. Pat. No. 4,146,396 (JP-A-52-0932), JP-A-59-93442, and JP-A-59-75475, (8) those which release a PUG with the decarboxylation of a carboxyl group as disclosed in JP-A-51-146828, JP-A-57-179842 and JP-A-59-04641, (9) those which have an —O—COOCR$_2$R$_b$—PUG structure and which release a PUG via reaction of the aldehyde following decarboxylation, (10) those which release a PUG with the formation of an isocyanate, as disclosed in JP-A-60-7429, and (11) those which release a PUG by a coupling reaction with the oxidized form of a color developing agent, as disclosed, for example, in U.S. Pat. No. 4,438,193.

Specific examples of divalent linking groups which can be represented by Time have been described in detail, for example, in JP-A-61-236549 and JP-A-1-269936. Preferred specific examples are indicated below, where (*) signifies the position at which, in general formula (I), —(Time)$_t$—PUG is bonded to V, and (*)(*) signifies the position to which the PUG is bonded.

T-(1)

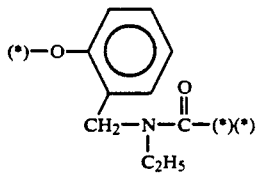

T-(2)

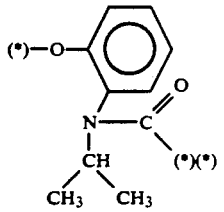

T-(3)

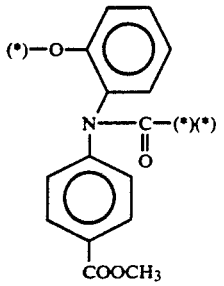

-continued
T-(4)
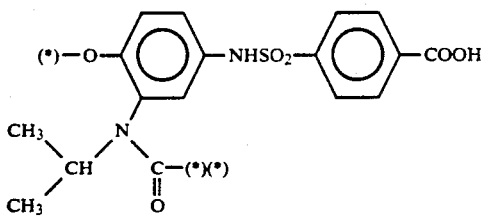
T-(5)
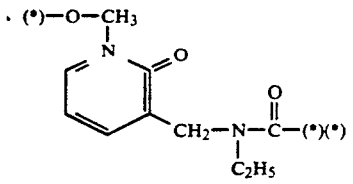
T-(6)
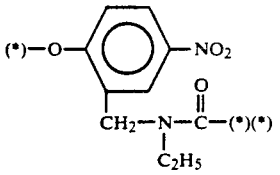
T-(7)
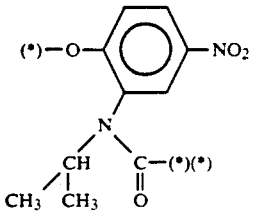
T-(8)
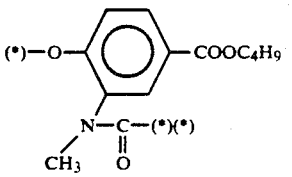
T-(9)
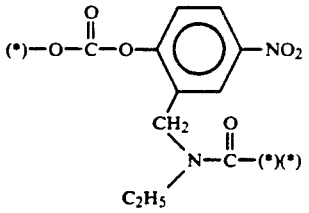
T-(10)
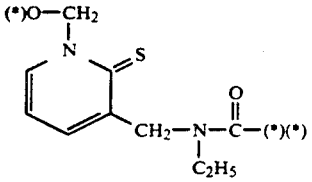
-continued
T-(11)
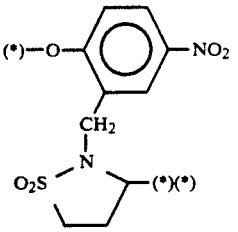
T-(12)
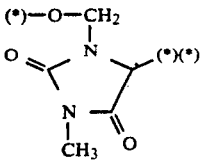
T-(13)
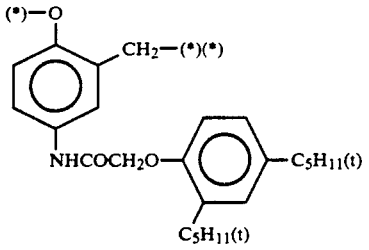
T-(14)
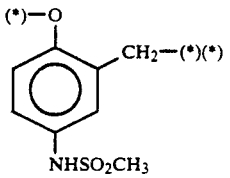
T-(15)
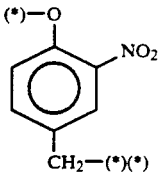
T-(16)
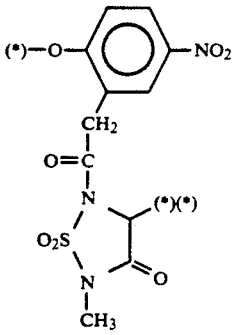
T-(17)
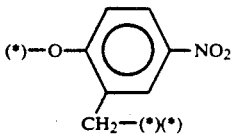

-continued
T-(18)
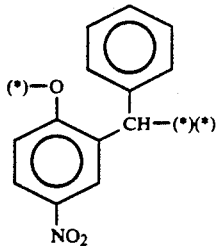
T-(19)
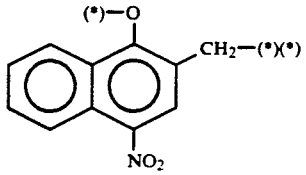
T-(20)
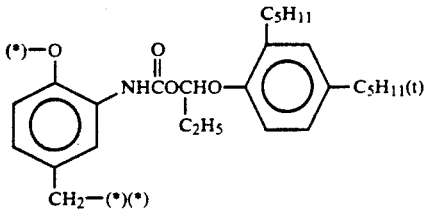
T-(21)
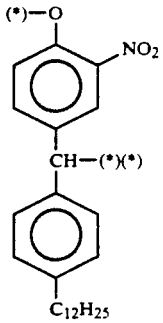
T-(22)
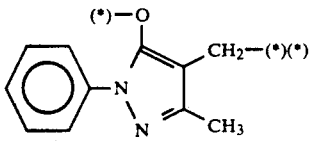
T-(23)
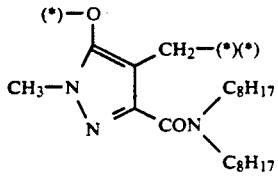
T-(24)
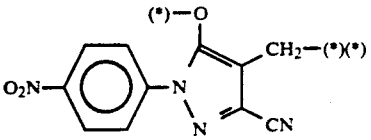
T-(25)
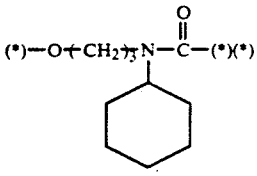
-continued
T-(26)
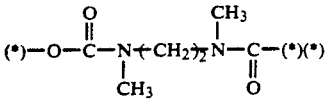
T-(27)
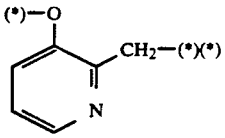
T-(28)
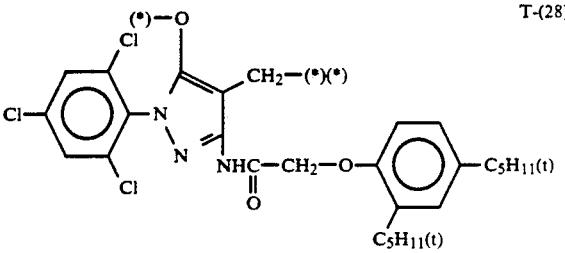
T-(29)
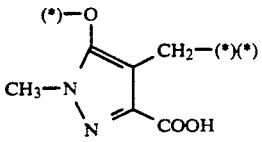
T-(30)
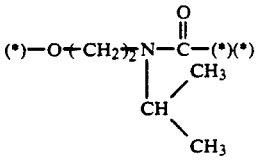
T-(31)
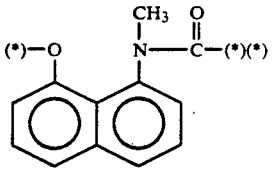
T-(32)
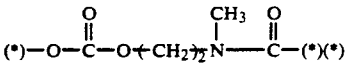
T-(33)
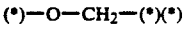
T-(34)
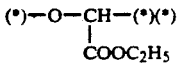
T-(35)
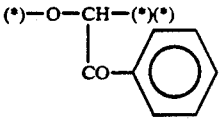
T-(36)
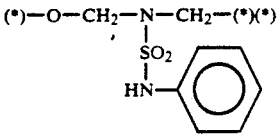

-continued

T-(37)

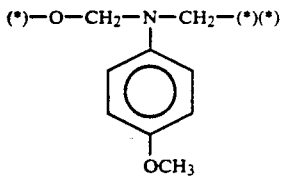

T-(38)

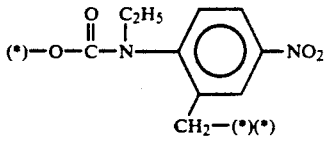

T-(39)

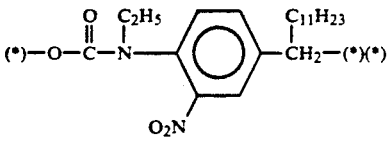

T-(40)

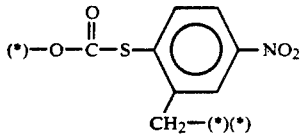

T-(41)

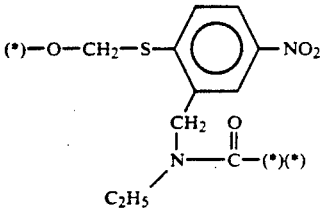

T-(42)

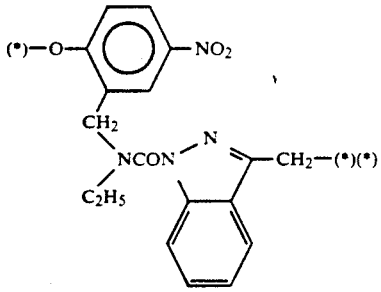

PUG represents a group which, as $(Time)_r$—PUG or PUG, has a development inhibiting action.

Development inhibitors which are represented by PUG or $(Time)_r$—PUG are known development inhibitors which have a hetero atom and are bonded to

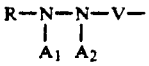

in formula (I) via thehetero atom. They have been described, for example, by C. K. E. Mees and T. H. James in *The Theory of Photographic Processes*, Third Edition, 1966, pages 344–346, published by MacMillan. Specific examples include mercaptotetrazoles, mercaptotriazoles, mercaptoimidazoles, mercaptopyrimidines, mercaptobenzimidazoles, mercaptobenzthiazoles, mercaptobenzoxazoles, mercaptothiadiazoles, benztriazoles, benzimidazoles, indazoles, adenines, guanines, tetrazoles, tetra-azaindenes, triazaindenes and mercaptoaryls.

The development inhibitors represented by PUG may be substituted. Examples of the substituent groups are indicated below, and these groups may be further substituted.

For example, the substituent groups may be an alkyl group, an aralkyl group, an alkenyl group, an alkynyl group, an alkoxy group, an aryl group, a nitro group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinyl group or a phosphoric acid amido group.

The preferred substituent groups are a nitro group, a sulfo group, a carboxyl group, a sulfamoyl group, a phosphono group, a phosphinyl group and a sulfonamido group.

The principal development inhibitors are indicated below:

1. Mercaptotetrazole Compounds (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazol)ethyltrimethylammonium chloride
(34) 1-(3-Phenoxycarbonylphenyl)-5-mercaptotetrazole
(35) 1-(3-Maleimidophenyl)-6-mercaptotetrazole 2. Mercaptotriazole Compounds (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Compounds (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptocyrimidine Compounds (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Compounds (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Compounds (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzthiazole Compounds (1) 2-Mercaptobenzthiazole
(2) 5-nitro-2-mercaptobenzthiazole
(3) 5-Carboxy-2-mercaptobenzthiazole
(4) 5-Sulfo-2-mercaptobenzthiazole 8. Mercaptobenzoxazole Compounds (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benztriazole Compounds (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Compounds (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Compounds (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole Compounds (1) 5-(4-Nitrophenyl)tetrazole
(2) 5-Phenyltetrazole
(3) 5-(3-Carboxyphenyl)tetrazole 13. Tetrazaindene Compounds (1) 4-Hydroxy-6-methyl-5-nitro-1,3,3a,7-tetra-azaindene
(2) 4-Mercapto-6-methyl-5-nitro-1,3,3a,7-tetra-azaindene 4. Mercaptoaryl Compounds (1) 4-Nitrothiophenol
(2) Thiophenol
(3) 2-Carboxythiophenol V represents a carbonyl group,

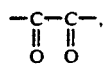

a sulfonyl group, a sulfoxy group,

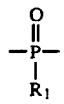

(where $R_1$ represents an alkoxy group or an aryloxy group), an iminomethylene group or a thiocarbonyl group, and V is preferably a carbonyl group.

The aliphatic groups represented by R are linear chain, branched or cyclic alkyl groups, alkenyl groups or alkynyl groups, and groups which have 1 to 30 carbon atoms are preferred. Those which have 1 to 20 carbon atoms are the most desirable. A branched alkyl group may be cyclized to form a saturated heterocyclic ring which contains one or more hetero atoms.

Examples include methyl, t-butyl, n-octyl, t-octyl, cyclohexyl, hexenyl, pyrrolidyl, tetrahydrofuryl and n-dodecyl groups.

The aromatic groups are single ringed or double ringed aryl groups, for example phenyl or naphthyl.

The heterocyclic groups are three to ten member, saturated or unsaturated heterocyclic rings which contain at least one atom selected from among nitrogen, oxygen and sulfur. These groups may be single ring compounds or they may form condensed rings with other aromatic rings or heterocyclic rings. Five or six member aromatic heterocyclic rings are preferred. Examples include a pyridine ring and imidazolyl, quinolinyl, benzimidazolyl, pyrimidinyl, pyrazolyl, isoquinolinyl, benzthiazolyl and thiazolyl groups.

R may be substituted with substituent groups. These groups may be further substituted. Examples of substituent groups for R include: an alkyl group, an aralkyl group, an alkenyl group, an alkynyl group, analkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group and a phosphoric acid amido group.

Furthermore, R or —(Time)$_t$—PUG in general formula (I) may have incorporated within it a ballast group of the type normally used in non-diffusible photographically useful additives such as couplers, and a group which promctes the adsorption of the compound represented by the general formula (I) on silver halides.

The ballast groups are organic groups which provide the compound represented by general formula (I) with sufficient molecular weight to prevent the compound from diffusing into other layers or into the processing baths. Examples of the ballast groups include an alkyl group, an aryl group, a heterocyclic group, an ether group, a thioether group, an amido group, a ureido group, a urethane group, a sulfonamido group, and combinations of these groups. Ballast groups which have substituted benzene rings are preferred, and those which have benzene rings substituted with branched alkyl groups are especially desirable.

Specific examples of groups which promote absorption on silver halides include a cyclic thioamido group, such as 4-thiazolin-2-thione, 4-imidazolin-2-thione, 2-thiohydantoin, rhodanine, thiobarbituric acid, tetrazolin-5-thione, 1,2,4-triazolin-3-thione, 1,2,4-triazolin-3-thione, 1,3,4-oxazolin-2-thione, benzimidazolin-2-thione, benzoxazolin-2-thione, benzothiazolin-2-thione, thiotriazine and 1,3-imidazolin-2-thione; a chain-like thioamido groups; an aliphatic mercapto group; an aromatic mercapto group; a heterocyclic mercapto group (when a nitrogen atom is adjacent to the carbon atom to which the —SH group is bonded, the groups are essentially the same as the cyclic thioamido group which are tautomers); of these mercapto groups a group which has a disulfide bond; a five or six membered nitrogen containing heterocyclic group comprising at least one carbon atoms and combinations of nitrogen, oxygen, or sulfur atom such as benzotriazole, triazole, tetrazole, indazole, benzimidazole, imidazole, benzothiazole, thiazole, thiazoline, benzoxazole, oxazole, oxazoline, thiadiazole oxathiazole, triazine and azaindene; and a heterocyclic quaternary salt such as a benzimidazolinium salt.

These may be substituted with appropriate substituent groups.

The groups described as substituent groups for R, for example, can be cited as such substituent groups.

Specific examples of the redox compounds which can be used in the present invention are indicated below, but the invention is not limited to these examples.

1.

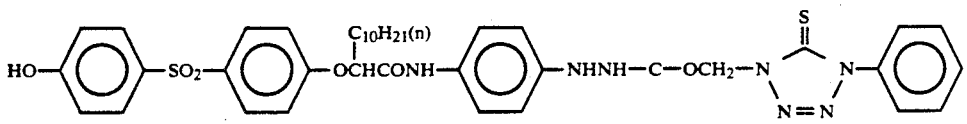

2.

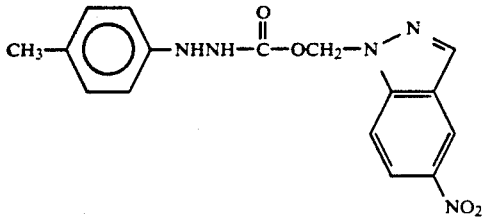

-continued
3.
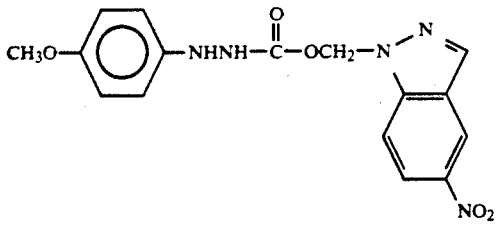
4.
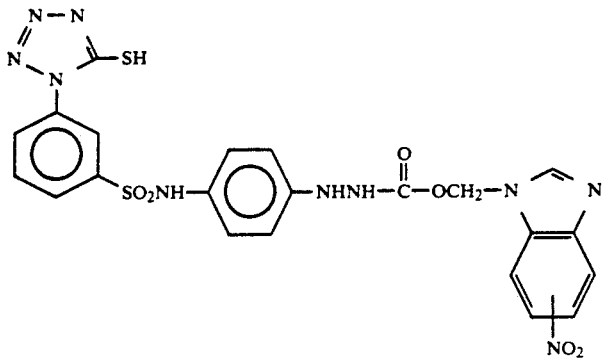
5.
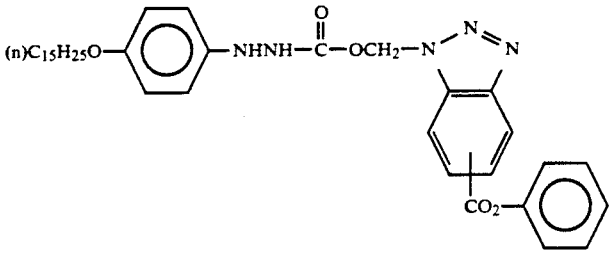
6.
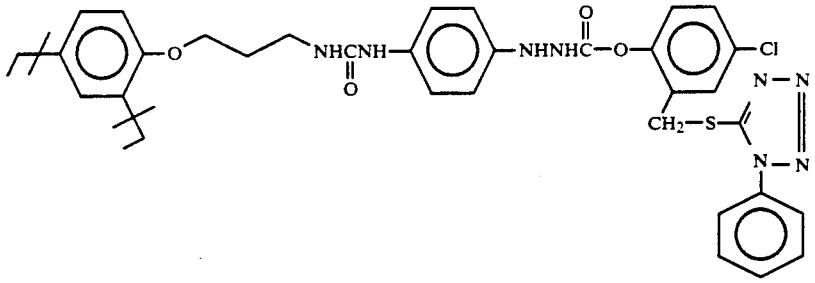
7.
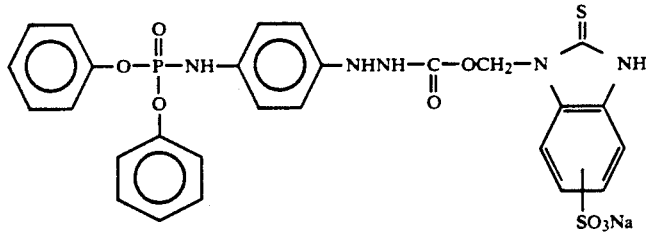
8.
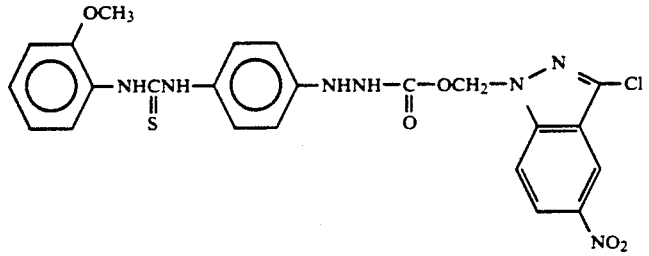

-continued
9.
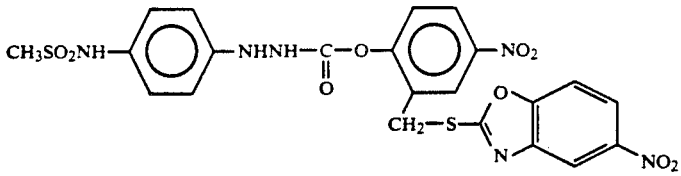
10.
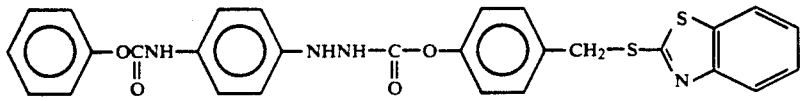
11.
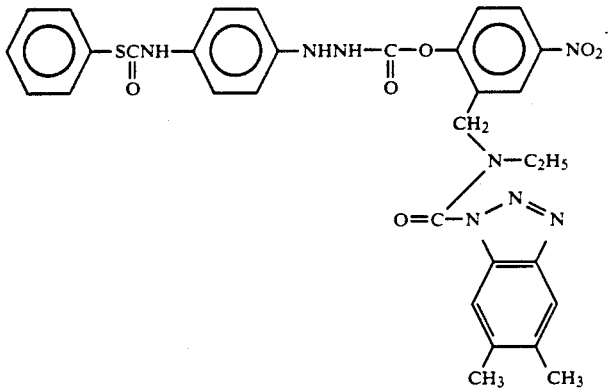
12.
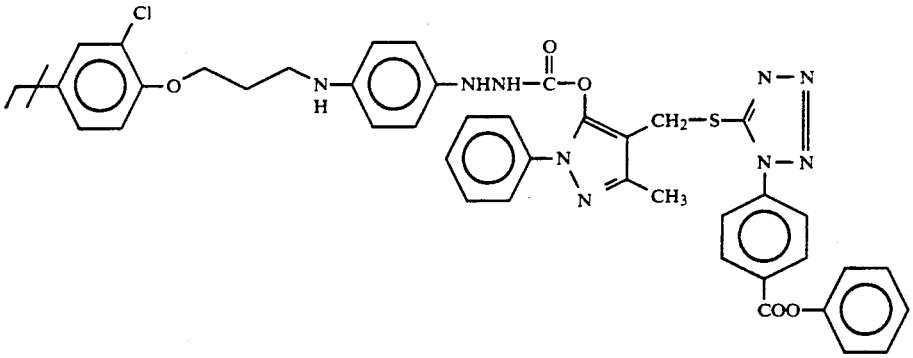
13.
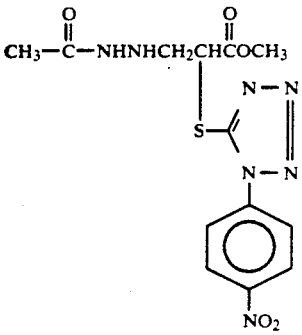

-continued
14.
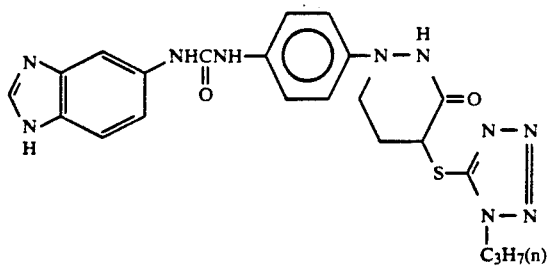
15.
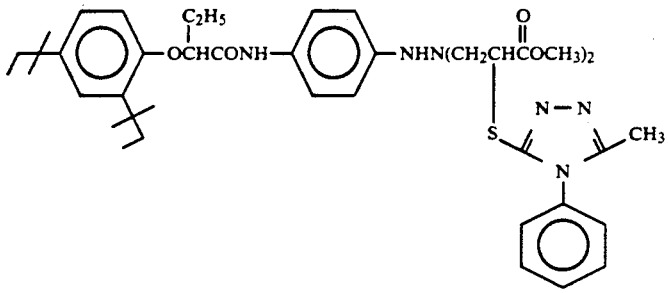
16.
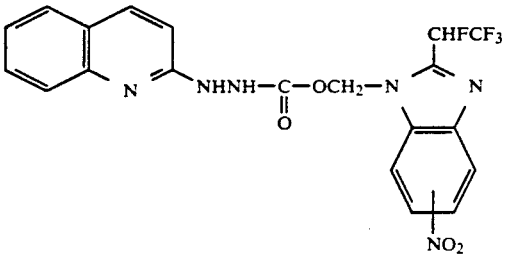
17.
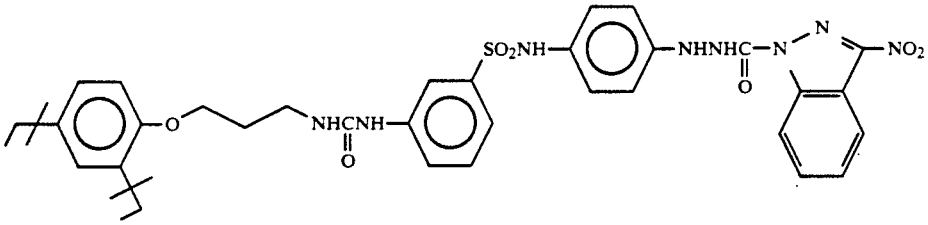
18.
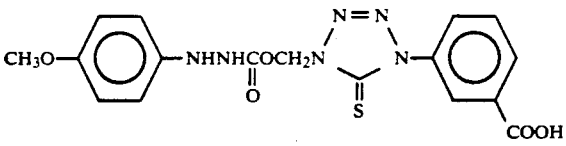
19.
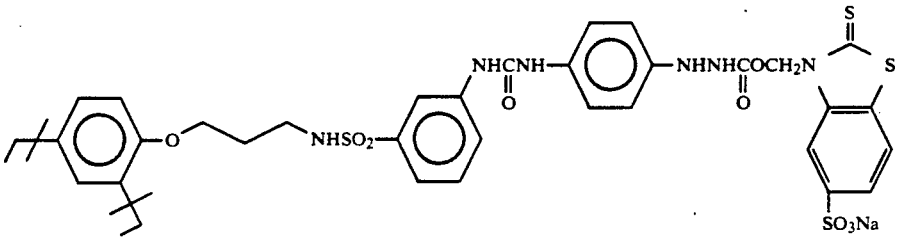
20.
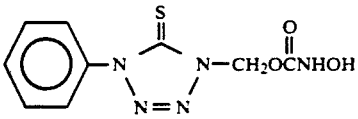

-continued
21.
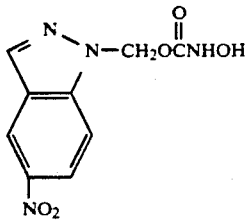
22.
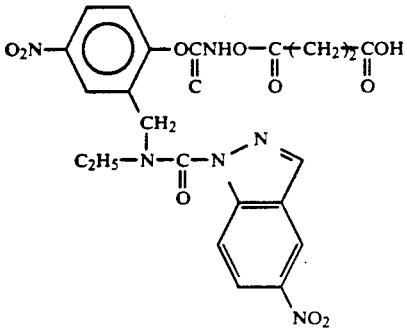
23.
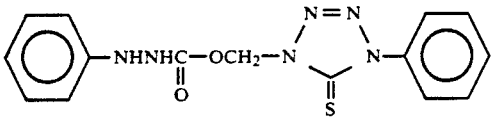
24.
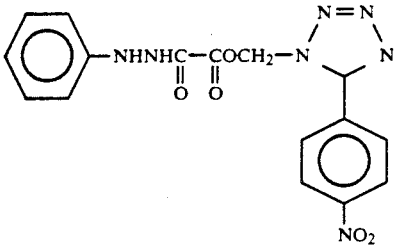
25.
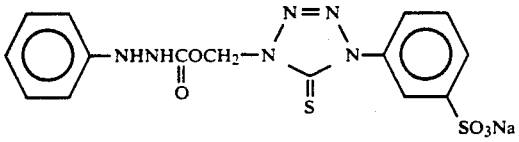
26.
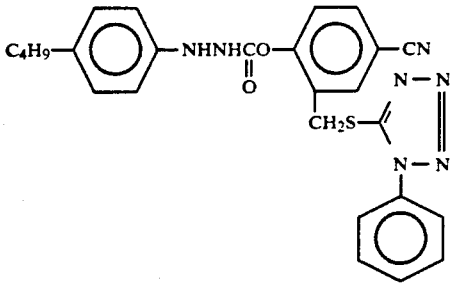
27.
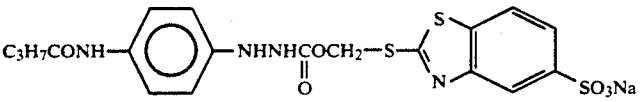

-continued
28.
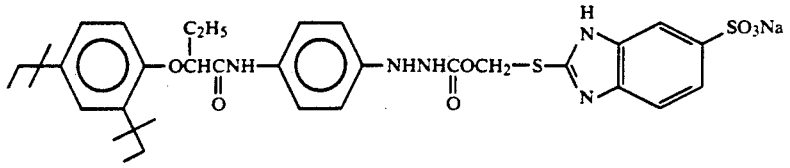
29.
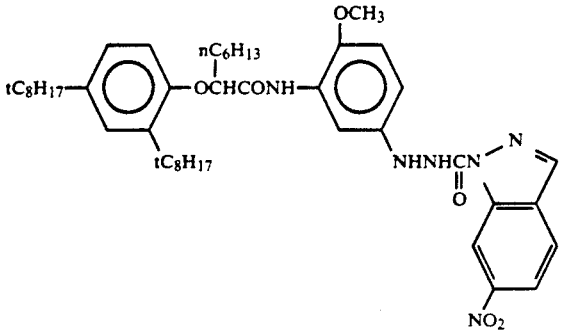
30.
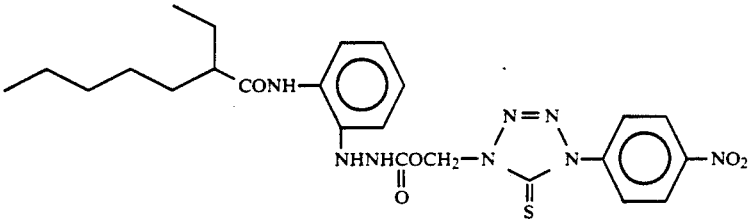
31.
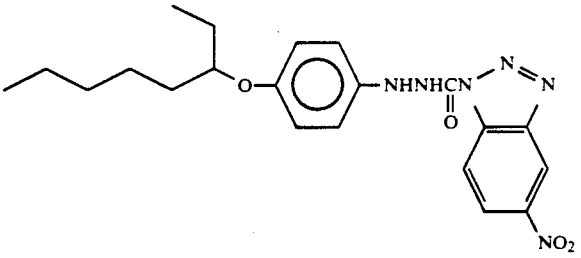
32.
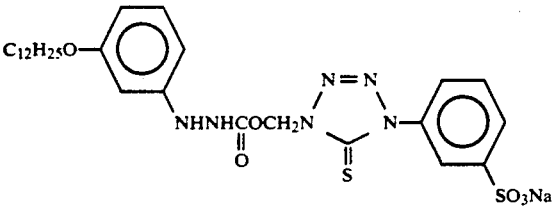
33.
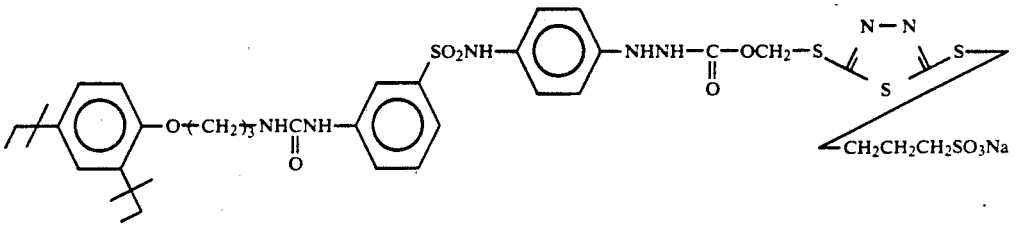

-continued
34.
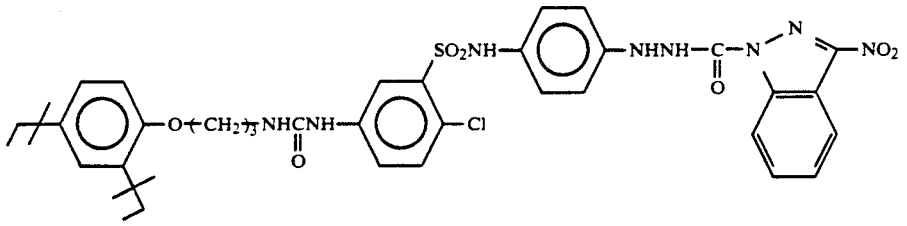
35.
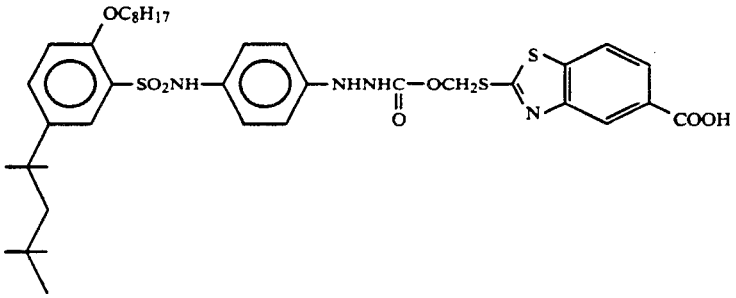
36.
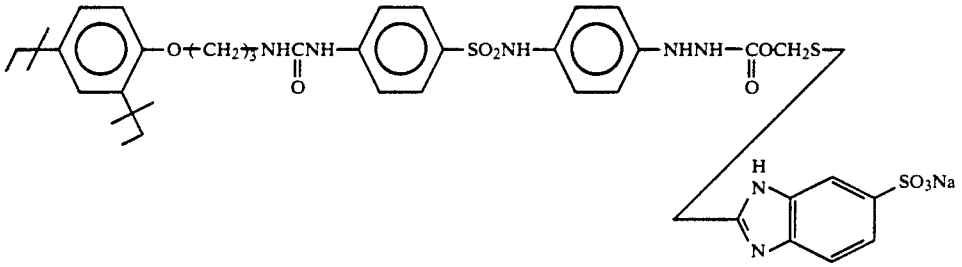
37.
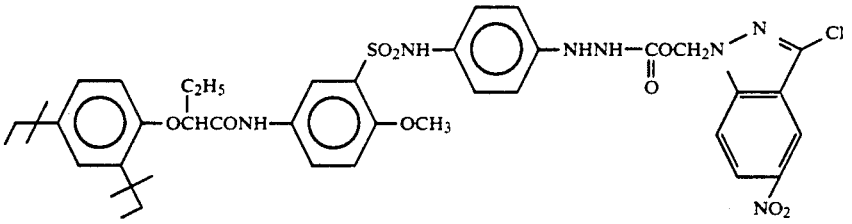
38.
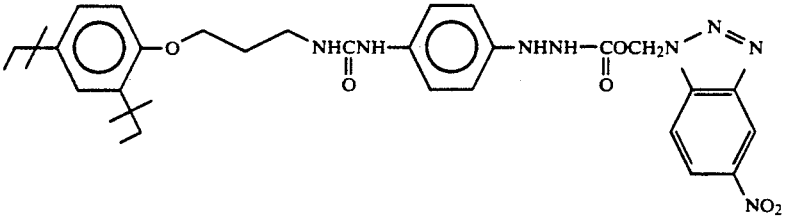
39.
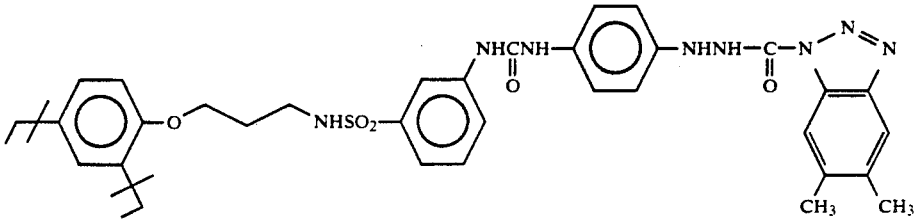

-continued
40.
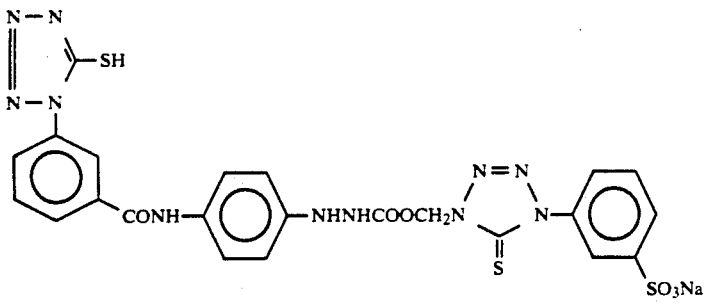
41.
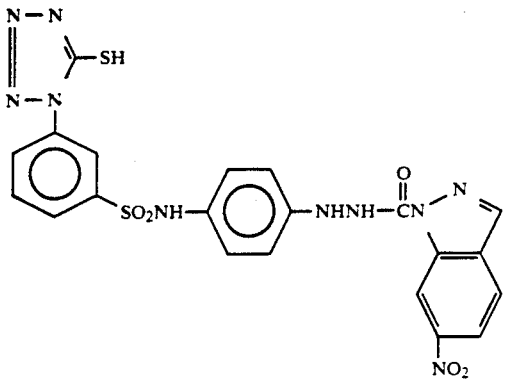
42.
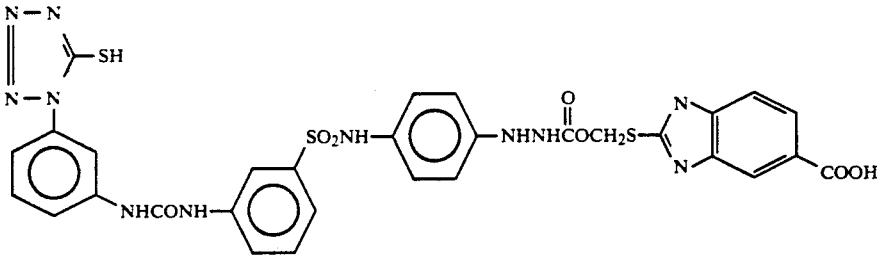
43.
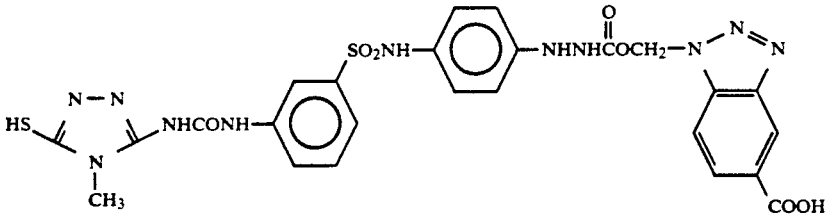
44.
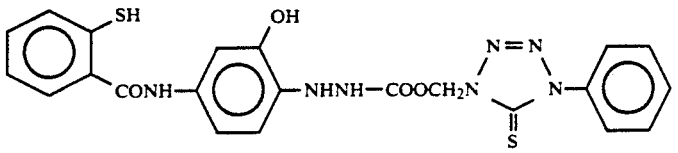

-continued
45.
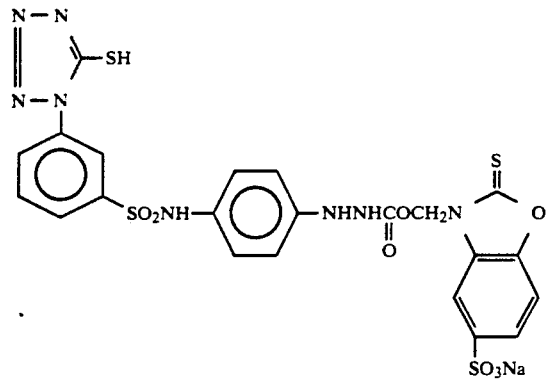
46.
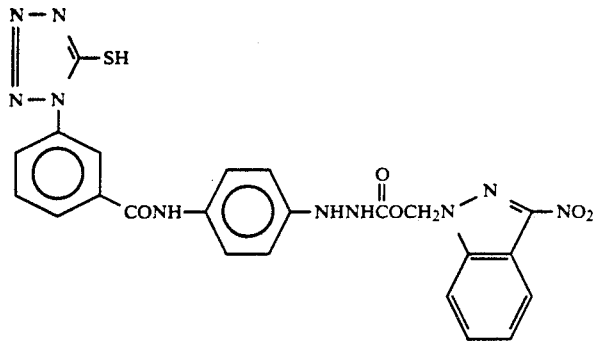
47.
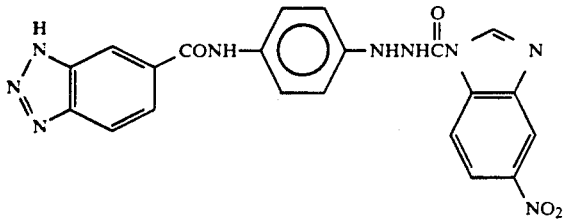
48.
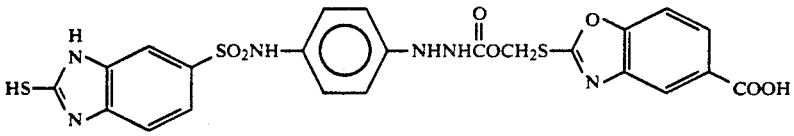
49.
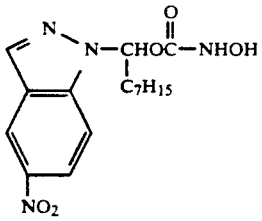
50.
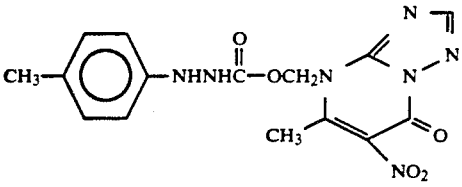
Methods for the synthesis of redox compounds which can be used in the present invention have been disclosed, for example, in JP-A-61-213847, JP-A-62-260153, JP-A-1-269936, U.S. Pat. Nos. 4,684,604, 3,379,529, 3,620,746, 4,377,634 and 4,332,878, JP-A-49-129536, JP-A-56-153336 and JP-A-56-153342.

Especially good property is obtained when the redox compounds of the present invention are dispersed in fine particles of a polymer.

Methods for the inclusion of hydrophobic substances in fine polymer particles were known in the past. For example, polymer loading methods in which a hydrophobic substance such as an oil soluble coupler is dissolved in a water miscible organic solvent and the solution is mixed with a loadable polymer latex have been disclosed, for example, in U.S. Pat. No. 4,203,716 (JP-B-58-35214), JP-B-60-56175, JP-A -54-32552, JP-A-53-126060, JP-A-53-137131, U.S. Pat. Nos. 4,201,589 and 4,199,363, West German Patent OLS 2,827,519, U.S. Pat. No. 4,304,769, European Patent 14,921A and U.S. Pat. No. 4,247,627. (The term "JP-B" as used herein signifies an "examined Japanese patent publication".) Furthermore, methods in which hydrophobic compounds are dissolved in a high boiling point organic solvent and polymer and emulsified and dispersed have been disclosed, for example, in JP-A-60-140344, West German Patent OLS 2,830,917, U.S. Pat. No. 3,619,195, JP-B-60-18978, JP-A-51-25133 and JP-A-50-102334.

The fine polymer particles which contain redox compounds of the present invention can be prepared by means of these known methods.

Use of the water insoluble and organic solvent soluble polymers indicated below is preferred in the present invention, but the invention is not limited to these polymers.

(A) Vinyl Polymers

Monomers which can form vinyl polymers of the present invention include acrylic acid esters, for example methyl acrylate, ethyl acrylate, n-propyl acrylate, isopropyl acrylate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate,, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acryalte, 2-(2-butoxyethoxy)ethyl acrylate, ω-methoxy-polyethyleneglycol acrylate (number of ethylene unit in the molecule is 9), 1-bromo-2-methoxyethyl acrylate and 1,1-dichloro-2-ethoxyethyl acrylate. The monomers indicated below can also be used to form vinyl polymers;

(1) Methacrylic acid esters: for example, methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxymethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxy-polyethyleneglycol methacrylate, (number of ethylene unit in the molecule is 6), allyl methacrylate, and the dimethylaminoethylmethyl chloride salt of methacrylic acid;

(2) Vinyl esters: for example, vinyl acetate, vinyl propionate, vinyl butyrate, vinyl iso-butyrate, vinyl caproate, vinyl chloroacetate, vinyl methoxyacetate, vinylphenyl acetate, vinyl benzoate and vinyl salicylate;

(3) Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide and tert-octylacrylamide;

(4) Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, hydroxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide;

(5) Olefins: for example, dicyclopentadiene, ethylene, propylene, 1-butene, 1-pentene, vinyl chloride, vinylidene chloride, isoprene, chloroprene, butadiene and 2,3-dimethylbutadine, and a styrene: for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and the methyl ester of vinyl benzoic acid;

(6) Vinyl ethers: for example, methyl vinyl ether, butyl vinyl ether, hexyl vinyl ether, methoxyethyl vinyl ether and dimethylaminoethyl vinyl ether; and (7) Others: for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile and vinylidene chloride.

Two or more of the above mentioned monomers can be used conjointly as co-monomers in the polymers of the present invention for various purposes (for example, for improving solubility).

Furthermore, monomers which have acid groups such as those indicated below can also be used as co-monomers within a range so that the copolymer does not become water soluble for solubility adjustment purposes: acrylic acid; methacrylic acid, itaconic acid; maleic acid; a monoalkyl itaconate, for example monomethyl itaconate, monoethyl itaconate and monobutyl itaconate; a monoalkyl maleate, for example, monomethyl maleate, monoethyl maleate and monobutyl maleate; citraconic acid; styrenesulfonic acid; vinylbenzylsulfonic acid; vinylsulfonic acid; an acryloyloxyalkylsulfonic acid, for example, acryloyloxymethylsulfonic acid, acryloyloxyethylsulfonic acid and acryloyloxypropylsulfonic acid and methacryloyloxypropylsulfonic acid; an acrylamidoalkylsulfonic acid, for example, 2-acrylamido-2-methylethanesulfonic acid, 2-acrylamido-2-methylpropanesulfonic acid and 2-acrylamido-2-methylbutanesulfonic acid; and a methacrylamidoalkylsulfonic acid, for example, 2-methacrylamido-2-methylethanesulfonic acid, 2-methacrylamido-2-methylpropanesulfonic acid and 2-methacrylamido-2-methylbutanesulfonic acid; and an alkali metal (for example Na, K) or ammonium ion salt of these acids.

In those cases where the vinyl monomers indicated so far and the other hydrophilic monomers among the vinyl monomers which can be used in the invention (referred to herein as monomers of which the homopolymers are water soluble) are used as co-monomers, no particular limitation is imposed upon the proportion of hydrophilic monomer in the copolymer provided that the copolymer does not become water soluble. But under normal circumstances, the proportion of hydrophilic monomer is preferably not more than 40 mol.%, more desirably not more than 20 mol.%, and most desirably not more that 10 mol.%. Furthermore, in those cases where th hydrophilic co-monomer which is copolymerized with a monomer of the present invention has abn acid group, the proportion in the copolymer of the co-monomer which has the acid group is usually not more than 20 mol.% and preferably not more than 10 mol.%, and the absence of such co-monomers is most desirable.

The monomers which can form the polymers of the present invention are preferably methacrylate based, acrylamide based or methacrylamide based. They are most desirably acrylamide based or methacrylamide based.

(B) Polymers Obtained by Condensation Polymerization and Poly-addition Reactions Polyesters obtained from polyhydric alcohols and polybasic acids, and polyamides obtained from diamines and dibasic acids, and from ω-amino-ω'-carboxylic acids, for example, are generally known as polymers obtained by condensation polymerization, and polyurethanes, for example, obtained from diisocyanates and dihydric alcohols are known as polymers obtained by means of a poly-addition reaction.

Glycols which have an HO—$R_1$—OH structure (where $R_1$ is a hydrocarbon chain, especially an aliphatic hydrocarbon chain, which has 2 to 12 carbon atoms), or polyalkylene glycols, are effective as polyhydric alcohols, and dibasic acids which have an HOO-C—$R_2$—COOH structure (where $R_2$ may represent a single bond or a hydrocarbon chain which has 1 to about 12 carbon atoms) are effective as the polybasic acids.

Examples of polyhydric alcohols include ethylen glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythritol, mannitol and sorbitol.

Examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, iso-pimelic acid, cyclopentadiene—maleic anhydride adduct and rosin—maleic acid adduct.

Examples of diamines include hydrazine, methylenediamine, ethylenediamine, trimethylenediamine, tetramethylene-diamine, hexamethylenediamine, dodecamethylenediamine, 1,4-diaminocyclohexane, 1,4-diaminomethylcyclohexane, o-aminoaniline, p-aminoaniline, 1,4-diaminomethylbenzene and (4-aminophenyl)ether.

Examples of ω-amino-ω-carboxylic acids include glycine, β-alanine, 3-aminopropionic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid.

Examples of isocyanates include ethylenediisocyanate, hexamethylenediisocyanate, m-phenylenediisocyanate, p-phenylenediisocyanate, p-xylenediisocyanate, and 1,5-naphthyldiisocyanate.

(C) Cellulose Compounds

The cellulose compounds which can be used in the present invention are those which are soluble in the low boiling point water immiscible organic solvents used for emulsification purposes as described hereinbefore or hereinafter and which are insoluble in water at pH 7 at room temperature. They include, for example, cellulose nitrate, cellulose acetate, cellulose acetate propionate, cellulose acetate butyrate and 2-hydroxypropyl methyl cellulose, and hydrogenated phthallylated cellulose compounds which are preferred at this time.

Hydrogenated phthallylated cellulose compounds are represented, for example, by the following general formula:

$$R_m^1R_n^2R_p^3R_q^4A$$

In this formula, A represents a glucose residue of the cellulose structure, $R^1$ represents a hydroxyalkyl group which has 2 to 4 carbon atoms, $R^2$ represents an alkyl group which has 1 to 3 carbon atoms, $R^3$ represents a monoacyl group of tetrahydrophthalic acid or hexahydrophthalic acid, $R^4$ represents an aliphatic monoacyl group which has 1 to 3 carbon atoms, m is from 0 to 1.0, n is from 0 to 2.0, p is from 0.2 to 1.0, and q is from 0 to 2.0, and the total of m+n+p has a maximum value of 3 (the numerical values indicate numbers of mols).

Examples of $R^1$ include the 2-hydroxyethyl group, the 2-hydroxypropyl group and the 4-hydroxybutyl group.

Furthermore, examples of $R^4$ include the acetyl group, the propionyl group and the butyryl group.

Examples of hydrogenated phthallylated cellulose compounds which can be used in the present invention are indicated below, but the invention is not limited to these examples. The numerical values shown in the parentheses with the illustrative compounds P-168) to P-174) set forth below indicate the number of mols of the substituent group per glucose residue.

(D) Others

For example, polyesters and polyamides obtained by means of ring opening polymerization:

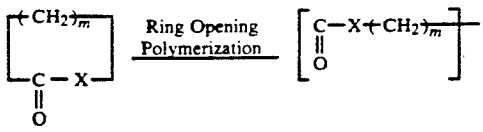

In this formula, X represents —O— or —NH—, and m represents an integer of from 4 to 7. Moreover, the —$CH_2$— groups may include branching.

Examples of such monomers include β-propiolactone, ε-caprolactone, dimethylpropiolactone, α-pyrrolidone, α-piperidone, ε-caprolactam, and α-methyl-ε-caprolactam.

Optionally, two or more types of the polymer of the present invention as described above can be used conjointly.

The water insoluble polymers in the present invention are polymers having a solubility such that not more than 3 grams, and preferably not more than 1 gram, can be dissolved in 100 gramns of distilled water.

The oil soluble polymers used in the present invention preferably contain from 30 to 70% of a component of molecular weight not more than 40,000.

Specific examples of the polymers which can be used in the present invention are indicated below, where the numbers which appear in parenthesis after the polymer name in polymers P-1) to P-167) indicate the mol percent of the monomers but the invention is not limited to these examples.

| Example | Polymer Type |
|---|---|
| P-1) | Poly(vinyl acetate) |
| P-2) | Poly(vinyl propionate) |
| P-3) | Poly(methyl methacrylate) |
| P-4) | Poly(ethyl methacrylate) |
| P-5) | Poly(ethyl acrylate) |
| P-6) | Vinyl acetate/vinyl alcohol copolymer (95:5) |
| P-7) | Poly(n-butyl acrylate) |
| P-8) | Poly(n-butyl methacrylate) |
| P-9) | Poly(isobutyl methacrylate) |
| P-10) | Poly(isopropyl methacrylate) |
| P-11) | Poly(decyl methacrylate) |
| P-12) | Butyl acrylate/acrylamide copolymer (95:5) |
| P-13) | Poly(chloromethyl acrylate) |
| P-14) | 1,4-Butanediol/adipic acid polyester |
| P-15) | Ethylene glycol/sebacic acid polyester |
| P-16) | Polycaprolactone |
| P-17) | Poly(2-tert-butylphenyl acrylate) |
| P-18) | Poly(4-tert-butylphenyl acrylate) |
| P-19) | n-Butyl methacrylate/N-vinyl-2-pyrrolidone copolymer (90:10) |
| P-20) | Methyl methacrylate/vinyl chloride copolymer (70:30) |
| P-21) | Methyl methacrylate/styrene copolymer (90:10) |
| P-22) | Methyl methacrylate/ethyl acrylate copolymer (50:50) |
| P-23) | n-Butyl methacrylate/methyl methacrylate copolymer (50:50) |
| P-24) | Vinyl acetate/acrylamide copolymer (85:15) |
| P-25) | Vinyl chloride/vinyl acetate copolymer (65:35) |
| P-26) | Methyl methacrylate/acrylonitrile copolymer (65:35) |
| P-27) | Diacetoneacrylamide/methyl methacrylate copolymer (50:50) |
| P-28) | Vinyl methyl ketone/isobutyl methacrylate copolymer (55:45) |
| P-29) | Ethyl methacrylate/n-butyl acrylate copolymer (70:30) |
| P-30) | Diacetoneacrylamide/n-butyl acrylate copolymer (60:40) |
| P-31) | Methyl methacrylate/cyclohexyl methacrylate copolymer (50:50) |
| P-32) | n-Butyl acrylate/styrene methacrylate/diacetone-acrylamide copolymer (70:20:10) |
| P-33) | N-Tert-butylacrylamide/methyl methacrylate/acrylic acid copolymer (60:30:10) |
| P-34) | Methyl methacrylate/styrene/vinylsulfonamide copolymer (70:20:10) |
| P-35) | Methyl methacrylate/phenyl vinyl ketone copolymer (70:30) |
| P-36) | n-Butyl acrylate/methyl methacrylate/n-butyl methacrylate copolymer (35:35:30) |
| P-37) | n-Butyl acrylate/pentyl methacrylate/N-vinyl-2-pyrrolidone copolymer (38:38:24) |
| P-38) | Methyl methacrylate/n-butyl methacrylate/isobutyl methacrylate/acrylic acid copolymer (37:29:25:9) |
| P-39) | n-Butyl methacrylate/acrylic acid copolymer (95:5) |
| P-40) | Methyl methacrylate/acrylic acid copolymer (95:5) |
| P-41) | Benzyl methacrylate/acrylic acid copolymer (90:10) |
| P-42) | n-Butyl methaerylate/methyl methacrylate/benzyl methacrylate/acrylic acid copolymer (35:35:25:5) |
| P-43) | n-Butyl methacrylate/methyl methacrylate/benzyl methacrylate copolymer (35:35:30) |
| P-44) | Poly(3-pentyl acrylate) |
| P-45) | Cyclohexyl methacrylate/methyl methacrylate/n-propyl methacrylate copolymer (37:29:34) |
| P-46) | Poly(pentyl methacrylate) |
| P-47) | Methyl methacrylate/n-butyl methacrylate copolymer (65:35) |
| P-48) | Vinyl acetate/vinyl propionate copolymer (75:25) |
| P-49) | n-Butyl methacrylate/3-acryloxybutane-1-sulfonic acid, sodium salt, copolymer (97:3) |
| P-50) | n-Butyl methacrylate/methyl methacrylate/acrylamide copolymer (35:35:30) |
| P-51) | n-Butyl methacrylate/methyl methacrylate/vinyl chloride copolymer (37:36:27) |
| P-52) | n-Butyl methacrylate/styrene copolymer (90:10) |
| P-53) | Methyl methacrylate/N-vinyl-2-pyrrolidone copolymer (90:10) |
| P-54) | n-Butyl methacrylate/vinyl chloride copolymer (90:10) |
| P-55) | n-Butyl methacrylate/styrene copolymer (70:30) |
| P-56) | Poly(N-sec-butylacrylamide) |
| P-57) | Poly(N-tert-butylacrylamide) |
| P-58) | Diacetoneacrylamide/methyl methacrylate copolymer (62:38) |
| P-59) | Cyclohexyl methacrylate/methyl acrylate copolymer (60:40) |
| P-60) | N-Tert-butylacrylamide/methyl methacrylate copolymer (60:40) |
| P-61) | Poly(N-n-butylacrylamide) |
| P-62) | Tert-butyl methacrylate/N-tert-butylacrylamide copolymer (50:50) |
| P-63) | Tert-butyl methacrylate/methyl methacrylate copolymer (70:30) |
| P-64) | Poly(N-tert-butylmethacrylamide) |
| P-65) | N-Tert-butylacrylamide/methyl methacrylate copolymer (60:40) |
| P-66) | Methyl methacrylate/acrylonitrile copolymer (70:30) |
| P-67) | Methyl methacrylate/vinyl methyl ketone copolymer (38:62) |
| P-68) | Methyl methacrylate/styrene copolymer (75:25) |
| P-69) | Methyl methacrylate/hexyl methacrylate copolymer (70:30) |
| P-70) | Poly(benzyl acrylate) |
| P-71) | Poly(4-biphenyl acrylate) |
| P-72) | Poly(4-butoxycarbonylphenyl acrylate) |
| P-73) | Poly(sec-butyl acrylate) |
| P-74) | Poly(tert-butyl acrylate) |
| P-75) | Poly(3-chloro-2,2-(chloromethyl)propyl acrylate) |
| P-76) | Poly(2-chlorophenyl acrylate) |
| P-77) | Poly(4-chlorophenyl acrylate) |
| P-78) | Poly(pentachlorophenyl acrylate) |
| P-79) | Poly(4-cyanobenzyl acrylate) |
| P-80) | Poly(cyanoethyl acrylate) |
| P-81) | Poly(4-cyanophenyl acrylate) |
| P-82) | Poly(4-cyano-3-mercaptobutyl acrylate) |
| P-83) | Poly(cyclohexyl acrylate) |
| P-84) | Poly(2-ethoxycarbonylphenyl acrylate) |
| P-85) | Poly(3-ethoxycarbonylphenyl acrylate) |
| P-86) | Poly(4-ethoxycarbonylphenyl acrylate) |
| P-87) | Poly(2-ethoxyethyl acrylate) |
| P-88) | Poly(2-ethoxypropyl acrylate) |
| P-89) | Poly(1H,1H,5H-octafluoropentyl acrylate) |
| P-90) | Poly(heptyl acrylate) |

-continued

| Example | Polymer Type |
|---|---|
| P-91) | Poly(hexadecyl acrylate) |
| P-92) | Poly(hexyl acrylate) |
| P-93) | Poly(isobutyl acrylate) |
| P-94) | Poly(isopropyl acrylate) |
| P-95) | Poly(3-methoxybutyl acrylate) |
| P-96) | Poly(2-methoxycarbonylphenyl acrylate) |
| P-97) | Poly(3-methoxycarbonylphenyl acrylate) |
| P-98) | Poly(4-methoxycarbonylphenyl acrylate) |
| P-99) | Poly(2-methoxyethyl acrylate) |
| P-100) | Poly(4-methoxyphenyl acrylate) |
| P-101) | Poly(3-methoxypropyl acrylate) |
| P-102) | Poly(3,5-dimethyladamantyl acrylate) |
| P-103) | Poly(3-dimethylaminophenyl acrylate) |
| P-104) | Poly(vinyl tert-butyrate) |
| P-105) | Poly(2-methylbutyl acrylate) |
| P-106) | Poly(3-methylbutyl acrylate) |
| P-107) | Poly(1,3-dimethylbutyl acrylate) |
| P-108) | Poly(2-methylpentyl acrylate) |
| P-109) | Poly(2-naphthyl acrylate) |
| P-110) | Poly(phenyl methacrylate) |
| P-111) | Poly(propyl acrylate) |
| P-112) | Poly(m-tolyl acrylate) |
| P-113) | Poly(o-tolyl acrylate) |
| P-114) | Poly(p-tolyl acrylate) |
| P-115) | Poly(N,N-dibutylacrylamide) |
| P-116) | Poly(isohexylacrylamide) |
| P-117) | Poly(iso-octylacrylamide) |
| P-118) | Poly(N-methyl-N-phenylacrylamide) |
| P-119 | Poly(adamantyl methacrylate) |
| P-120) | Poly(benzyl methacrylate) |
| P-121) | Poly(2-bromoethyl methacrylate) |
| P-122) | Poly(2-tert-butylaminoethyl methacrylate) |
| P-123) | Poly(sec-butyl methacrylate) |
| P-124) | Poly(tert-butyl methacrylate) |
| P-125) | Poly(2-chloroethyl methacrylate) |
| P-126) | Poly(2-cyanoethyl methacrylate) |
| P-127) | Poly(2-cyanomethylphenyl methacrylate) |
| P-128) | Poly(4-cyanophenyl methacrylate) |
| P-129) | Poly(cyclohexyl methacrylate) |
| P-130) | Poly(dodecyl methacrylate) |
| P-131) | Poly(diethylaminoethyl methacrylate) |
| P-132) | Poly(2-ethylsulfinylethyl methacrylate) |
| P-133) | Poly(hexadecyl methacrylate) |
| P-134) | Poly(hexyl methacrylate) |
| P-135) | Poly(2-hydroxypropyl methacrylate), |
| P-136) | Poly(4-methoxycarbonylphenyl methacrylate) |
| P-137) | Poly(3,5-dimethyladamantyl methacrylate) |
| P-138) | Poly(dimethylaminoethyl methacrylate) |
| P-139) | Poly(3,3-dimethylbutyl methacrylate) |
| P-140) | Poly(3,3-dimethyl-2-butyl methacrylate) |
| P-141) | Poly(3,5,5-trimethylhexyl methacrylate) |
| P-142) | Poly(octadecyl methacrylate) |
| P-143) | Poly(tetradecyl methacrylate) |
| P-144) | Poly(4-butoxycarbonylphenylmethacrylamide) |
| P-145) | Poly(4-carboxyphenylmethacrylamide) |
| P-146) | Poly(4-ethoxycarbonylphenylmethacrylamide) |
| P-147) | Poly(4-methoxycarbonylphenylmethacrylamide) |
| P-148) | Poly(butylbutoxycarbonyl methacrylate) |
| P-149) | Poly(butyl chloroacrylate) |
| P-150) | Poly(butyl cyanoacrylate) |
| P-151) | Poly(cyclohexyl chloroacrylate) |
| P-152) | Poly(chloroethyl acrylate) |
| P-153) | Poly(ethyl ethoxycarbonylmethacrylate) |
| P-154) | Poly(ethyl ethacrylate) |
| P-155) | Poly(fluoroethyl methacrylate) |
| P-156) | Poly(hexyl hexyloxycarbonylmethacrylate) |
| P-157) | Poly(chloroisobutyl acrylate) |
| P-158) | Poly(isopropyl chloroacrylate) |
| P-159) | Trimethylenediamine/glutaric acid polyamide |
| P-160) | Hexamethylenediamine/adipic acid polyamide |
| P-161) | Poly(α-pyrrolidone) |
| P-162) | Poly(ε-caprolactam) |
| P-163) | Hexamethylenediisocyanate/1,4-butanediol polyurethane |
| P-164) | p-Phenylenediisocyanate/ethylene glycol polyurethane |
| P-165) | Poly(vinyl hydrogenated phthalate) |
| P-166) | Poly(vinylacetal phthalate) |
| P-167) | Poly(vinyl acetal) |
| P-168) | 2-Hydroxypropylmethylcellulose hexahydrophthalate (2-hydroxypropyl group: 0.28, methyl group: 1.65, hexahydrophthalyl group: 0.60) |

-continued

| Example | Polymer Type |
|---|---|
| P-169) | 2-Hydroxypropylmethylcellulose hexahydrophthalate (2-hydroxypropyl group: 0.33, methyl group: 1.60, hexahydrophthalyl group: 0.69) |
| P-170) | 2-Hydroxypropylmethylcellulose hexahydrophthalate (2-hydroxypropyl group: 0.22, methyl group: 1.81, hexahydrophthalyl group: 0.84) |
| P-171) | Cellulose acetate hexahydrophthalate (acetyl group: 1.23, hexahydrophthalyl group 0.67) |
| P-172) | 2-Hydroxypropyl-4-hydroxybutylmethylcellulose hexahydrophthalate (2-hydroxypropyl group: 0.28, 4-hydroxybutyl group 0.06, methyl group: 1.53, hexahydrophthalyl group 0.39) |
| P-173) | 2-Hydroxypropylethylcellulose tetrahydrophthalate (2-hydroxypropyl group: 0.44, ethyl group: 0.92, tetrahydrophthalyl group: 0.41) |
| P-174) | 2-Hydroxypropylmethylcellulose acetate hexahydrophthalate (2-hydroxypropyl group: 0.16, methyl group: 1.50, acetyl group: 0.42, hexahydrophthalyl group 0.68) |
| These compounds can be prepared using known methods, such as those disclosed, for example, in U.S. Pat. No. 3,392,022 and JP-B-49-17367. | |
| P-175) | Tert-butylacrylamide/polyoxyethylene methacrylate copolymer (90:10) (the number of the oxyethylene unit in polyoxyethylene is 1 to 50) |

EXAMPLE OF SYNTHESIS (1)

Preparation of Methyl Methacrylate Polymer P-3

Methyl methacrylate (50.0 grams), 0.5 gram of poly(-sodium acrylate), 0.1 gram of dodecyl mercaptan and 200 ml of distilled water were introduced into a three necked flask having a 500 ml capacity and heated to 80° C. with stirring under a blanket of nitrogen. Azobis(-dimethylisobutyrate) (500 mg) was added as a polymerization initiator and the polymerization was started.

The polymerization mixture was cooled after polymerizing for a period of 2 hours, and 48.7 grams of the polymer P-3 was obtained by recovering the polymer beads by filtration and washing them with water. The portion having a molecular weight of not more than 40,000 observed on measuring the molecular weight using GPC was 53%.

EXAMPLE OF SYNTHESIS (2)

Preparation of t-Butylacrylamide Polymer P-57

A mixture comprising 50.0 gram sof t-butyl-acrylamide, 50 ml of isopropyl alcohol and 250 ml of toluene was introduced into a three necked flask having a 500 ml capacity and heated to 80° C. with stirring under a blanket of nitrogen.

Ten ml of a toluene solution which contained 500 mg of azobisisobutyronitrile was added as a polymerization initiator and the polymerization was started.

The polymerization mixture was cooled after polymerizing for a period of 3 hours, and 47.9 gram sof P-57 was obtained by pouring the reaction mixture into 1 liter of hexane, recovering the solid which precipitated out by filtration, washing the solid with hexane and then drying the solid by heating under reduced pressure.

The portion having a molecular weight of not more than 40,000 observed on measuring the molecular weight using GPC was 36%.

Methods for including the redox compounds of the present invention in the fine polymer particles include (1) methods in which the redox compounds are dissolved in a water miscible organic solvent, the solution so obtained is mixed with a loadable polymer latex, and the redox compound is loaded onto the polymer, and (2) methods in which the redox compound and the polymer are dissolved in a low boiling point organic solvent which is insoluble in water (i.e., solubility for water not more than 30%), and the solution so obtained is emulsified and dispersed in an aqueous phase (emulsification promotors, such as surfactants for example, and gelatin for example can be used, as required, at this time). In both cases, removal of the unwanted organic solvent after including the redox compound in the fine polymer particles is desirable from the point of view of storage stability. Furthermore, there is an advantage with the former method in that no large force is required for emulsification and dispersion when including the redox compound in the fine polymer particles, but it is difficult to include large quantities of the redox compound in the polymer. On the other hand, with the latter method, large force is required for emulsification and dispersion, but large amounts of the redox compound can be included in the polymer and, moreover, the size of the polymer particles can also be controlled. Hence, the reactivity of the redox compound can be controlled, and a plurality of redox compounds which have different effects on photographic characteristics can be included uniformly in the fine polymer particles in any ratio, and this method is preferable to the former method as the method of dispersion.

Dispersions of fine polymer particles which contain the redox compounds of the present invention can be prepared in the following way.

The redox compound and the polymer are completely dissolved in a low boiling point organic solvent and then the solution is dispersed as fine particles ultrasonically, using a colloid mill, or using a desorber for example in water, preferably in an aqueous hydrophilic colloid solution, and most desirably in an aqueous gelatin solution, with the use of a dispersion promotor such as a surfactant, as required, and included in the coating liquid.

Removal of the low boiling point solvent from the dispersion which has been prepared is useful for stabilizing the dispersion, and especially for preventing precipitation of the redox compound during storage. Methods for the removal of the low boiling point organic solvent include heating and distillation under reduced pressure, heating at normal pressure and distillation under an atmosphere of nitrogen or argon, noodle washing, and ultra-filtration, for example.

A low boiling point organic solvent is an organic solvent which is useful at the time of emulsification and dispersion, which can be removed ultimately from the photographic material in practice during the drying process at the time of coating or by using the methods afore-mentioned, which has a low boiling point and a certain solubility in water and which can be removed by washing with water for example.

Examples of low boiling point organic solvents include ethyl acetate, butyl acetate, ethyl propionate, sec-butyl alcohol, methyl ethyl ketone, methyl iso-butyl ketone, $\beta$-ethoxyethyl acetate, methylcellosolve and cyclohexanone.

Moreover, organic solvents which are completely miscible with water, for example, methyl alcohol, ethyl alcohol, acetone and tetrahydrofuran, can be used conjointly.

Two or more of these organic solvents can be used in combination, as required.

The average particle size of the particles in the dispersions obtained in this way is preferably from 0.02 $\mu$ to 2 $\mu$, and most desirably from 0.04 $\mu$ to 0.4 $\mu$. The particle size of the particles in the emulsified material can be measured, for example, by using a device such as the Nanosizer made by the British Coal Tar Co.

Various photographically useful hydrophobic substances can be included in the fine polymer particles in the emulsions of the present invention provided that they are included in an amount such that the redox compound is able to fulfill its role satisfactorily.

Examples of such photographically useful hydrophobic substances include agents for reducing the melting points of the redox compounds, high boiling point organic solvents, colored couplers, non-color forming couplers, developing agents, developing agent precursors, development inhibitors, development inhibitor precursors, ultraviolet absorbers, development accelerators, gradation controlling agents such as hydroquinones, dyes, dye releasing agents, anti-oxidants, fluorescent whiteners and anti-foggants. Furthermore, these hydrophobic substances can be used conjointly.

The aforementioned redox compounds are used in the present invention normally at a rate of from $1.0\times10^{-6}$ to $5.0\times10^{-2}$ mol, and preferably at a rate of from $1.0\times10^{-5}$ to $1.0\times10^{-2}$ mol, per mol of silver. Furthermore, the redox compounds may be used individually, or a combination of two or more of these compounds can be used.

The aforementioned polymers in the present invention are normally used in amounts of from 10 to 400 percent by weight, and preferably of from 20 to 300 percent by weight, with respect to the redox compound.

The photographic materials in the present invention preferably have auxiliary layers, such as protective layers, intermediate layers, filter layers, anti-halation layers and backing layers, established appropriately, in addition to the silver halide emulsion layer.

The fine polymer particles which contain the redox compounds of the present invention can also be used by addition to any of the above mentioned layers as required. It is preferred that the polymer particles are added to the silver halide emulsion layer and/or the adjacent layer to the silver halide emulsion layer.

The redox compound of the present invention is preferably used in combination with a hydrazine compound.

Compounds which can be represented by the general formula (II) below are preferred as the hydrazine compounds which are used in the present invention.

$$R_1-\underset{\underset{A_1}{|}}{N}-\underset{\underset{A_2}{|}}{N}-G_1-R_2 \qquad \text{(II)}$$

In formula (II), $R_1$ represents an aliphatic group or an aromatic group, $R_2$ represents a hydrogen atom, an alkyl group, an aryl group, an alkoxy group, an aryloxy group, an amino group, a carbamoyl group or an oxycarbonyl group, $G_1$ represents a carbamoyl group, a sulfonyl group, a sulfoxy group, a $$-\overset{\overset{O}{\|}}{\underset{\underset{R_2}{|}}{P}}-$$

group where $R_2$ is as defined above or an iminomethylene group, and $A_1$ and $A_2$ both represent hydrogen atoms, or one represents a hydrogen atom and the other represents a substituted or unsubstituted alkylsulfonyl group, a substituted or unsubstituted arylsulfonyl group or a substituted or unsubstituted acyl group.

The aliphatic groups represented by $R_1$ in general formula (II) preferably have 1 to 30 carbon atoms, and they are most desirably linear chain, branched or cyclic alkyl groups which have 1 to 20 carbon atoms. The branched alkyl groups may be cyclized in such a way that a saturated heterocyclic ring containing one or more hetero atoms is formed. Furthermore, the alkyl group may have substituent groups, for example aryl, alkoxy, sulfoxy, sulfonamido or carbonamido groups.

The aromatic groups represented by $R_1$ in general formula (II) are single ring or double ring aryl groups or unsaturated heterocyclic groups. The unsaturated heterocyclic groups may be condensed with single ring or double ring aryl groups to form heteroaryl groups.

Examples of $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring or a benzothiazole ring. Of these, those which contain a benzene ring are preferred.

Aryl groups are especially desirable for $R_1$.

The aryl groups or unsaturated heterocyclic groups represented by $R_1$ may be substituted. Typical substituent groups include, for example, an alkyl grup, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a phosphoric acid amido group, a diacylamino group and an imido group. The preferred substituent groups are, for example, a linear chain, branched or cyclic alkyl group (which preferably has 1 to 20 carbon atoms), an aralkyl group (preferably a single ring or double ring group of which the alkyl part has 1 to 3 carbon atoms), an alkoxy group (which preferably has 1 to 20 carbon atoms), a substituted amino group (preferably an amino group substituted with an alkyl group which has 1 to 20 carbon atoms), an acylamino group (which preferably has 2 to 30 carbon atoms), a sulfonamido groups (which preferably has 1 to 30 carbon atoms), a ureido groups (which preferably has 1 to 30 carbon atoms) and a phosphoric acid amido group (which preferably has from 1 to 30 carbon atoms).

The alkyl grups represented by $R_2$ in general formula (II) are preferably alkyl groups which have 1 to 4 carbon atoms, and these may be substituted, for example, with a halogen atom, a cyano group, a carboxyl group, a fulfo group, an alkoxy group, a phenyl grup and a sulfonyl group.

The aryl groups are preferably single ring or double ring aryl groups, for example, groups which contain a benzene ring. These aryl groups may be substituted, for example, with a halogen atom, an alkyl group, a cyano group, a carboxyl group, a sulfo group and a sulfonyl group.

The alkoxy groups preferably have from 1 to 8 carbon atoms, and they may be substituted, for example, with a halogen atom and an aryl group.

The aryloxy groups preferably have a single ring and this ring may have a halogen atom, for example, as a substituent group.

The amino groups are preferably unsubstituted amino groups, or alkylamino groups which have 1 to 10 carbon atoms or arylamino groups. They may be substituted, for example, with an alkyl group, a halogen atom, a cyano group, a nitro group and a carboxyl group.

The carbamoyl groups are preferably unsubstituted carbamoyl groups or alkyl carbamoyl groups which have 2 to 10 carbon atoms or arylcarbamoyl groups. They may be substituted, for example, with an alkyl group, a halogen atom, a cyano group and a carboxyl group.

The oxycarbonyl groups are preferably alkoxycarbonyl groups which have 2 to 10 carbon atoms or aryloxycarbonyl groups. They may be substituted, for example, with an alkyl group, a halogen atom, a cyano group and a nitro group.

In those case where $G_1$ is a carbonyl group, the preferred groups among those which can be represented by $R_2$ are, for example, a hydrogen atom, an alkyl group (for example, methyl, trifluoromethyl, 3-hydroxypropyl, 3-methanesulfonamidopropyl, phenylsulfonylmethyl), an aralkyl group (for example, o-hydroxybenzyl) and an aryl group( for example, phenyl, 3,5-dichlorophenyl, o-methanesulfonamidophenyl, 4-methanesulfonylphenyl), and the hydrogen atom is especially desirable.

Furthermore, in those cases where $G_1$ is a sulfonyl group, $R_2$ is preferably an alkyl group (for example, methyl), an aralkyl group (for example, o-hydroxyphenylmethyl), an aryl group (for example, phenyl), or a substituted amino group (for example, dimethylamino).

In those cases where $G_1$ is a sulfoxy group, $R_2$ is preferably a cyanobenzyl group or a methylthiobenzyl group, and in those cases where $G_1$ is a

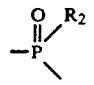

group, $R_2$ is preferably methoxy, ethoxy, butoxy, phenoxy or phenyl, and most desirably a phenoxy group.

In those cases where $G_1$ represents an N-substituted or unsubstituted iminomethylene group, $R_2$ is preferably methyl, ethyl, or a substituted or unsubstituted phenyl group.

The substituent groups listed in connection with $R_1$ are appropriate as substituent groups for $R_2$.

$G_1$ in general formula (II) is most desirably a carbonyl group.

Furthermore, $R_2$ may be a group such that the $G_1$—$R_2$ moiety is cleaved from the rest of the molecule and a cyclization reaction occurs, forming a ring structure which contains the atoms of the —$G_1$—$R_2$ moiety, and in practice such an $R_2$ group may be represented by the general formula (a)

$$-R_3-Z_1 \qquad \text{(a)}$$

In formula (a), $Z_1$ is a group which nucleophilically attacks $G_1$ and cleaves the $G_1$—$R_2$—$Z_1$ moiety from the rest of the molecule, and $R_3$ is a group derived by removing one hydrogen atom from $R_2$, and $Z_1$ can make a nucleophilic attack on $G_1$ and form a ring structure with $G_1$, $R_3$ and $Z_1$.

More precisely, $Z_1$ is a group which, when the reaction intermediate $R_1—N=N—G_1—R_3—Z_1$ has been formed by the oxidation of the hydrazine compound of general formula (II), readily undergoes a nucleophilic reaction with $G_1$ and causes the $R_1—N=N$ group to be cleaved from $G_1$. It may be a functional group, which diretly reacts with the group $G_1$, such as OH, SH or $NHR_4$ (where $R_4$ is a hydrogen atom, an alkyl group, an aryl group, $—COR_5$ or $—SO_2R_5$, where $R_5$ represents, for example, a hydrogen atom, an alkyl group, an aryl group or a heterocyclic group), or COOH, (whereupon the OH, SH, $NHR_4$, and —COOH groups may be temporarily protected in such a way that these groups form a free group by hydrolysis with an alkali for example), or a functional group which can react with $G_1$ as a result of the reaction of a nucleophilic reagent such as a hydroxide ion or a sulfite ion, such as

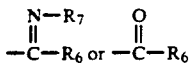

(where $R_6$ and $R_7$ represent a hydrogen atom, an alkyl group, an alkenyl group, an aryl group or a heterocyclic group).

Furthermore, the ring formed by $G_1$, $R_3$ and $Z_1$ is preferably a five or six membered ring.

Of the groups represented by general formula (a), those which can be represented by the general formulae (b) and (c) are preferred.

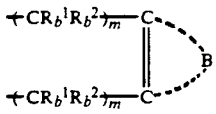

(b)

In this formula (b), $R_b^1$–$R_b^4$ represent, for example, a hydrogen atom, an alkyl group (which preferably has 1 to 12 carbon atoms), an alkenyl group (which preferably has 2 to 12 carbon atoms) or an aryl group (which preferably has 6 to 12 carbon atoms), and they may be the same or different. B represents the atoms which are required to complete a five or six membered ring which may have substituent groups, m and n represent 0 or 1, and (m+n) has a value of 1 or 2.

Examples of five or six membered rings formed by B include a cyclohexene ring, a cyclopentene ring, a benzene ring, a naphthalene ring, a pyridine ring and a quinoline ring.

$Z^1$ in formula (b) has the same significance as in general formula (a).

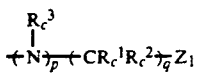

(c)

In this formula (c), $R_c^1$ and $R_c^2$ each represents, for example, a hydrogen atom, an alkyl group, an alkenyl group, an aryl group or a halogen atom, and they may be the same or different.

$R_c^3$ represents a hydrogen atom, an alkyl group, an alkenyl group or an aryl group.

Moreover, p represents 0 or 1, and q represents 1, 2, 3 or 4.

$R_c^1$, $R_c^2$ and $R_c^3$ may be joined together to form a ring provided that the structure allows for an intramolecular nucleophilic attack by $Z_1$ on $G_1$.

$R_c^1$ and $R_c^2$ are preferably a hydrogen atom, a halogen atom or an alkyl group, and $R_c^3$ is preferably an alkyl group or an aryl group.

Moreover, q preferably has a value of from 1 to 3, and when q is 1, p is 1, when q is 2, p is 0 or 1, and when q is 3, p is 0 or 1, and when q is 2 or 3 the $CR_c^1R_c^2$ groups may be the same or different.

$Z_1$ in formula (c) has the same significance as in general formula (a).

$A_1$ and $A_2$ each represents a hydrogen atom, an alkylsulfonyl group which has not more than 20 carbon atoms, an arylsulfonyl group (preferably an unsubstituted phenylsulfonyl group or a substituted phenylsulfonyl group in which the sum of the Hammett substituent constants is at least −0.5) or an acyl group which has not more than 20 carbon atoms (preferably an unsubstituted benzoyl group, or a substituted benzoyl group in which the sum of the Hammett substituent constants is at least −0.5), or a linear chain, branched or cyclic unsubstituted or substituted aliphatic acyl group (which can have a halogen atom, an ether group, a sulfonamido group, a carbonamido group, a hydroxyl group, a carboxyl group or a sulfonic acid group as a substituent group)).

$A_1$ and $A_2$ are most desirably hydrogen atoms.

$R_1$ or $R_2$ in general formula (II) may have incorporated within them ballast groups as normally used in non-diffusible photographically useful additives such as couplers. Ballast groups are comparatively inert groups in the photographic sense which have at least eight carbon atoms, and they can be selected, for example, from among an alkyl group, an alkoxy group, a phenyl group, an alkylphenyl group, a phenoxy group and an alkylphenoxy group.

$R_1$ or $R_2$ in general formula (II) may have incorporated within them groups which are adsorbed readily on silver halide grain surfaces. Examples of such absorbing groups included the groups such as a thiourea group, a heterocyclic thioamido group, a mercaptoheterocyclic group and a triazole group, as disclosed, for example, in U.S. Pat. Nos. 4,385,108 and 4,459,347, JP-A-59-195233, JP-A-59-00231, JP-A-59-201045, JP-A-59-201046, JP-A-59-201047, JP-A -59-201048, JP-A-59-201049, JP-A-61-170733, JP-A-61-270744, JP-A-62-948, JP-A-63-234244, JP-A-63-234246 and Japanese Patent Application No. 62-67510.

Specific examples of the compounds represented by general formula (II) are indicated below, but the invention is not limited by these compounds.

II-1)
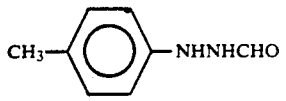
II-2)
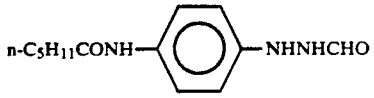
II-3)
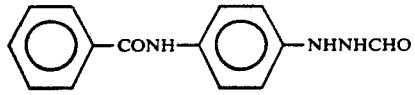
II-4)
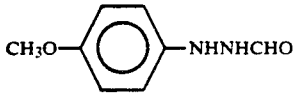
II-5)
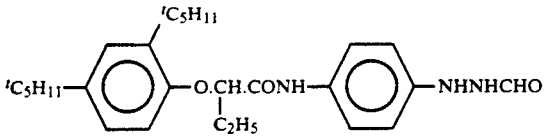
II-6)
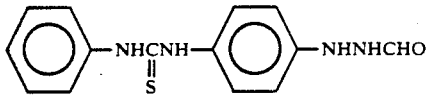
II-7)
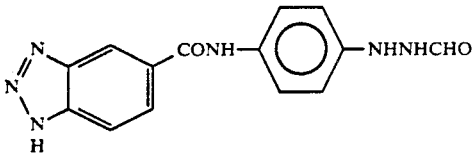
II-8)
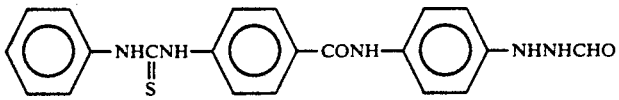
II-9)
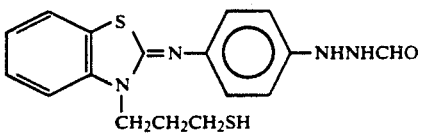
II-10)
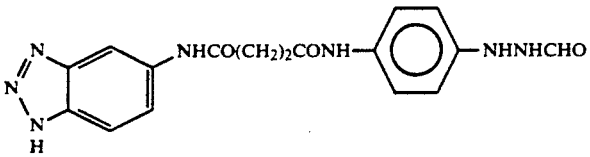
II-11)
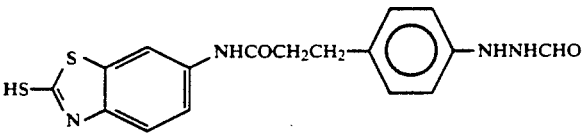

-continued
II-12)
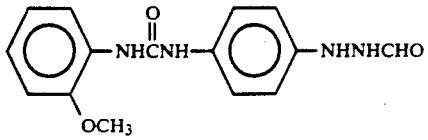
II-13)
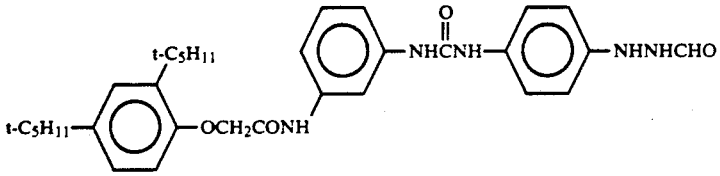
II-14)
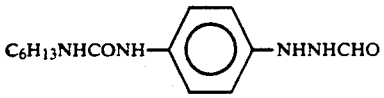
II-15)
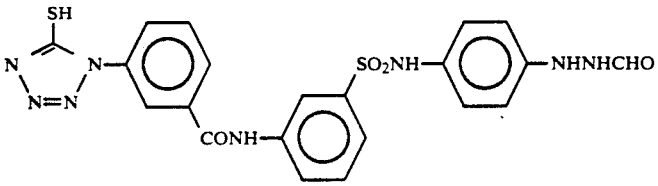
II-16)
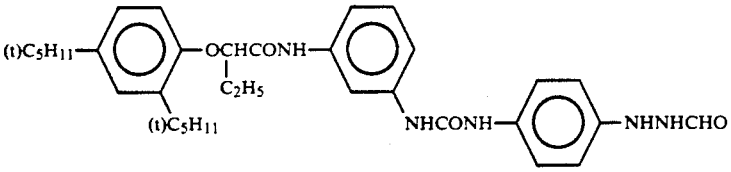
II-17)
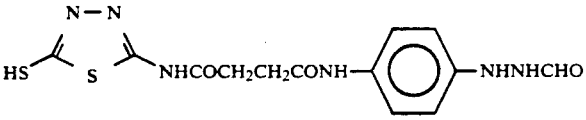
II-18)
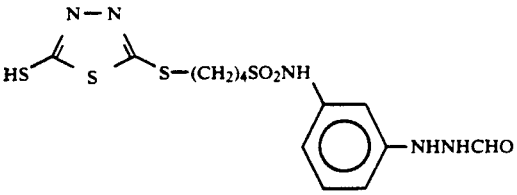
II-19)
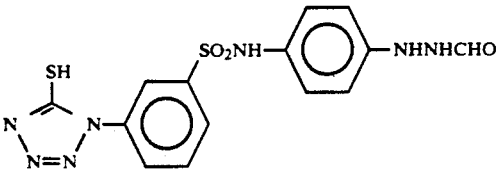
II-20)
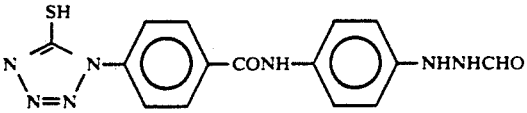

-continued
II-21)
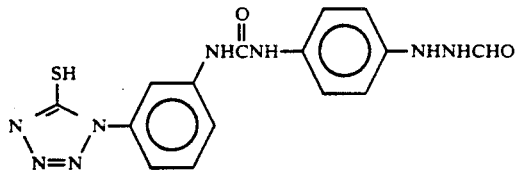
II-22)
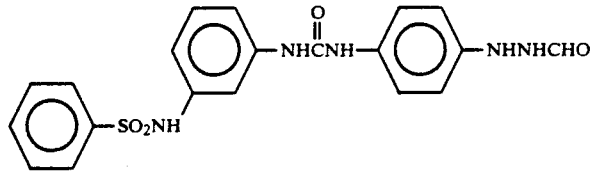
II-23)
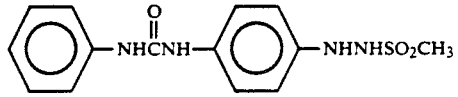
II-24)
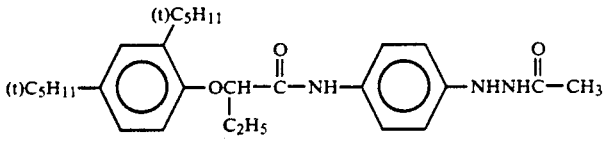
II-25)
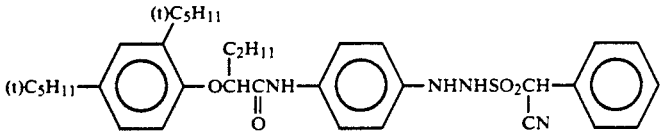
II-26)
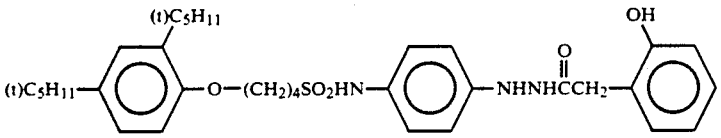
II-27)
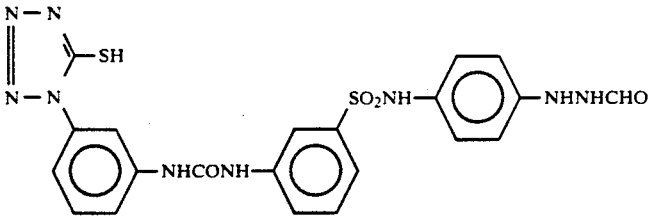
II-28)
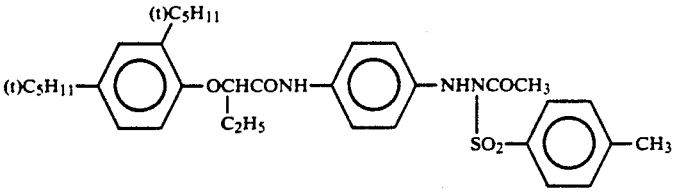
II-29)
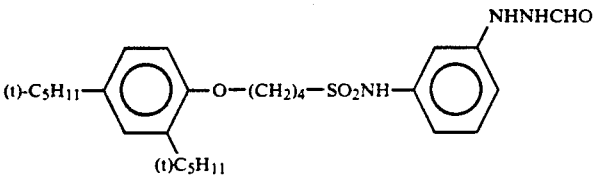

-continued
II-30)
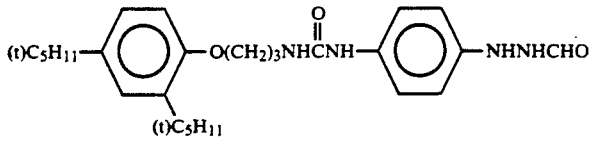
II-31)
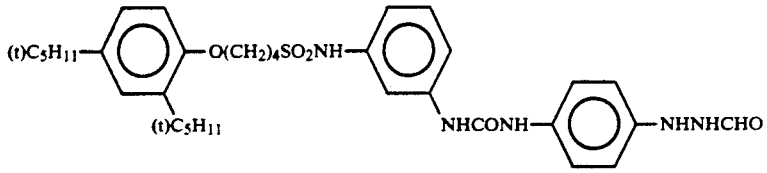
II-32)
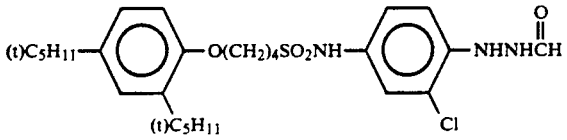
II-33)
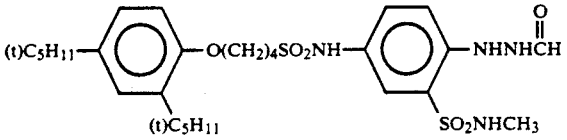
II-34)
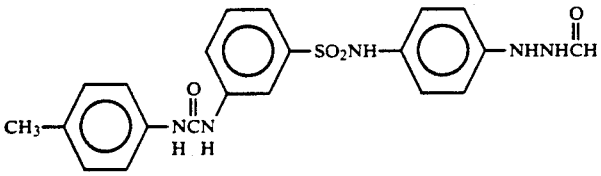
II-35)
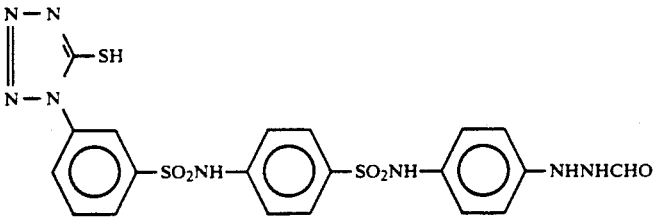
II-36)
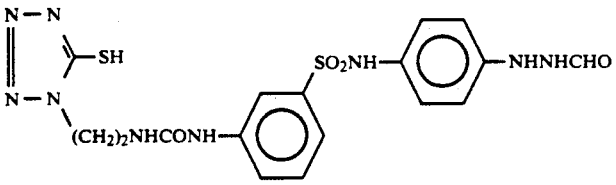
II-37)
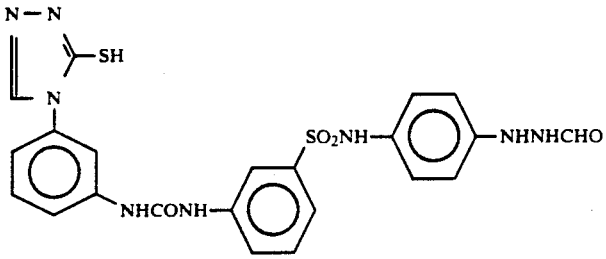

-continued
II-38)
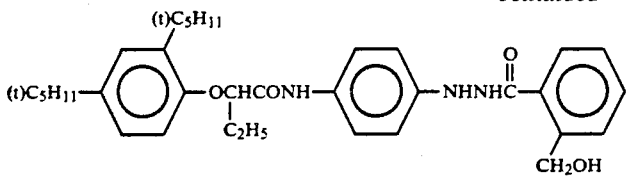
II-39)
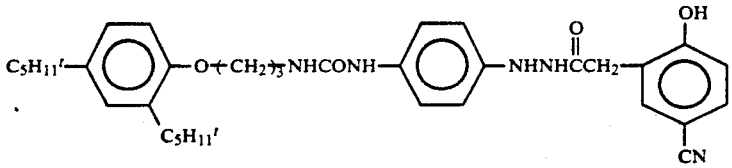
II-40)
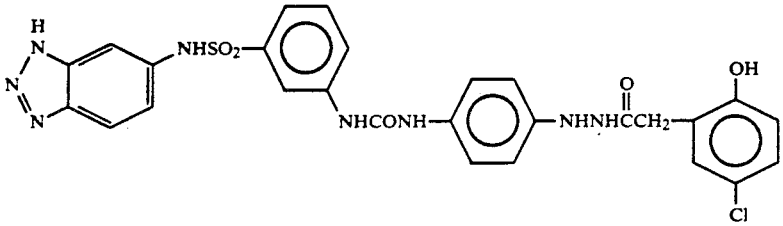
II-41)
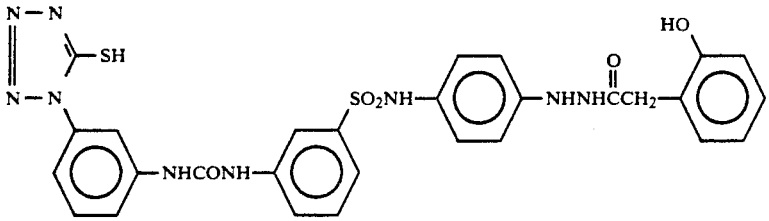
II-42)
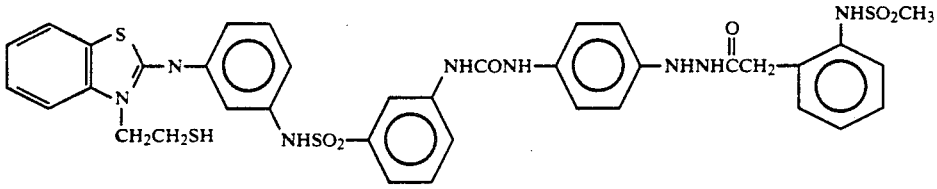
II-43)
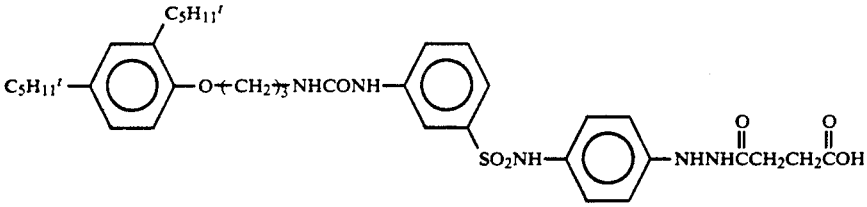
II-44)
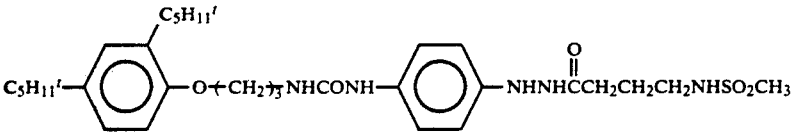
II-45)
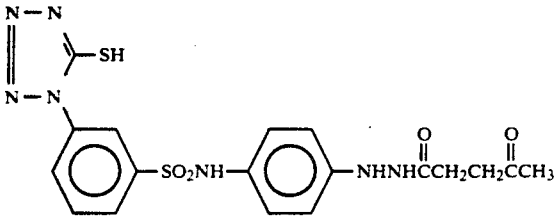

-continued
II-46)
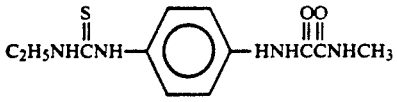
II-47)
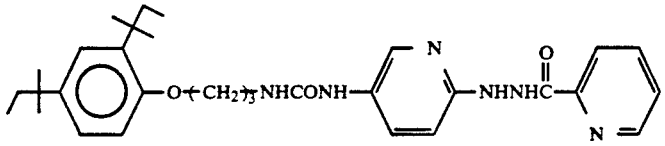
II-48)
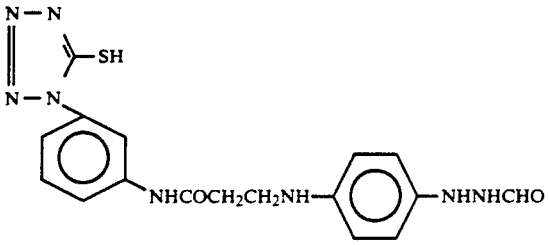
II-49)
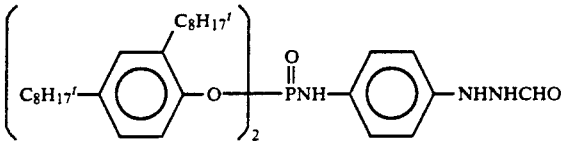
II-50)
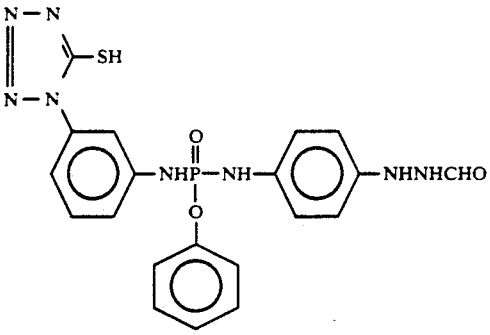
II-51)
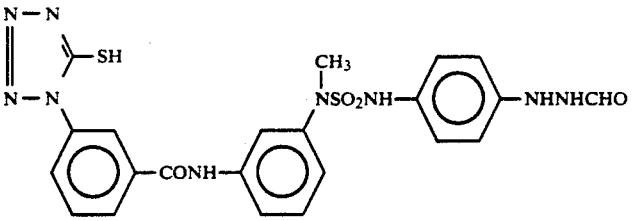
II-52)
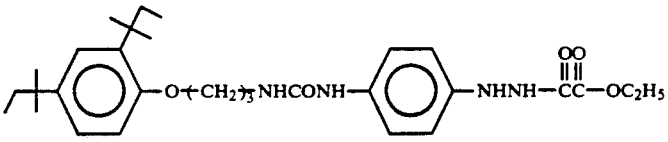
II-53)
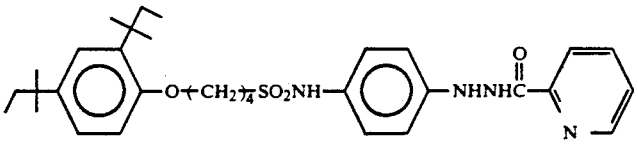

-continued

II-54)

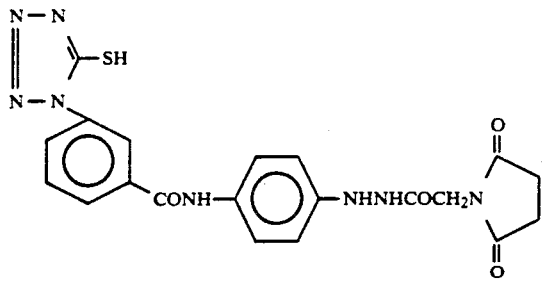

The hydrazine compounds which can be used in this invention include, as well as those indicated above, those disclosed in *Research Disclosure*, Item 23516 (November 1983, p.346), and in the literature cited therein, and in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, European Patent 217,310, JP-A-63-32538, JP-A-63-104047, JP-A-63-121838, JP-A -63-129337, JP-A-63-234244, JP-A-63-234245, JP-A-63-234246, JP-A-63-223744, JP-A-63-294552, JP-A-63-306448, JP-A-1-10233, U.S. Pat. No. 4,686,167, JP-A-62-178246, JP-A-63-234244, JP-A -63-234245, JP-A-63-234246, JP-A-63-294552, JP-A-63-306438, JP-A-1-10233, JP-A-1-90439 and Japanese Patent Application Nos. 63-105682, 63-114118, 63-110051, 63-114119, 63-116239, 63-147339, 63-179760, 63-229163, H1-18377, H1-18378, H1-18379, H1-15755, H1-16814, H1-40792, H1-42615 and H1-42616.

The hydrazine compound of the present invention is preferably included in a silver halide emulsion layer, but it may be included instead in a non-photosensitive hydrophilic colloid layer (for example, in a protective layer, an intermediate layer, a filter layer or anti-halation layer). In those case where the compound which is used in practice is soluble in water it can be dissolved in water for addition to the hydrophilic colloid in the form of a solution. In cases where it is only sparingly soluble in water it can be dissolved in an organic solvent which is miscible with water, such as an alcohol, an ester or a ketone, for example, for addition to the hydrophilic colloid. In those cases where the hydrozine compound is added to a silver halide emulsion layer, the addition can be made at any time during the period from the commencement of chemical ripening and prior to coating, but addition during the period after the completion of chemical ripening and prior to coating is preferred. Addition to the coating liquid which is to be used for coating is most desirable.

The amount of the hydrazine compound of the present invention included is preferably selected as the optimum amount in accordance with the grain size of the silver halide emulsion, the halogen composition, the method and degree of chemical sensitization, the layer in which the hydrazine compound is to be included and its relationship with the silver halide emulsion layer, and the type of anti-fogging compounds which are being used. The test methods for making such a selection are well known in the industry. Normally, the use of an amount of from $1\times10^{-6}$ mol to $1\times10^{-1}$ mol per mol of silver halide is preferred, and the use of from $1\times10^{-5}$ to $4\times10^{-2}$ mol per mol of silver halide is most desirable.

The silver halide emulsions used in the present invention may be of any composition, such as silver chloride, silver chlorobromide, silver iodobromide or silver iodochlorobromide for example.

The average grain size of the silver halide used in the present invention is preferably very fine (for example, not more than 0.7 $\mu$), and a grain size of not more than 0.5 $\mu$ is most desirable. Fundamentally, no limitation is imposed upon the grain size distribution, but the use of mono-dispersions is preferred. Here, the term "mono-dispersion" signifies that the emulsion is comprised of grains such that at least 95% of the grains in terms of the number of grains or by weight are of a size within ±40% of the average grain size.

The silver halide grains in the photographic emulsion may have a regular crystalline form such as a cubic or octahedral form, or they may have an irregular form such as a spherical or plate-like form, or they may have a form which is a composite of these forms.

The silver halide grains may be such that the interior and surface layer are comprised of a uniform phase, or the interior and surface layers may be comprised of different phases. Use can also be made of mixtures of two or more types of silver halide emulsion which have been prepared separately.

Cadmium salts, sulfites, lead salts, thallium salts, rhodium salts or complex salts thereof, and iridium salts or complex salts thereof, may also be present during the formation and physical ripening processes of the silver halide grains in the silver halide emulsions used in the present invention.

Water soluble dyes can be included in the emulsion layers or other hydrophilic colloid layers in the present invention as filter dyes, for the prevention of irradiation, or of various other purposes. Dyes for further reducing photographic speed, and preferably ultraviolet absorbers which have a spectral absorption peak in the intrinsically sensitive region of silver halides and dyes which essentially absorb light principally within the 350 nm–600 nm range for increasing stability with respect to safe-lighting when materials are being handled as light-room photosensitive materials, can be used as filter dyes.

These dyes may be added to the emulsion layer or they may be added together with a mordant to a non-photosensitive hydrophilic layer above the silver halide emulsion layer, which is to say which is further from the support than the silver halide emulsion layer, and fixed in this layer, depending on the intended purpose of the dye.

The amount of dye added differs according to the molecular extinction coefficient of the dye, but it is normally from $10^{-2}$ g/m$^2$ to 1 g/m$^2$, and preferably from 50 mg/m$^2$ to 500 mg/m$^2$.

Specific examples of dyes have been disclosed in detail in JP-A-63-64039, and some are indicated below.

(1)

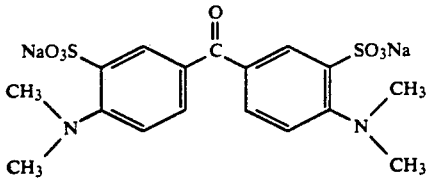

(2)

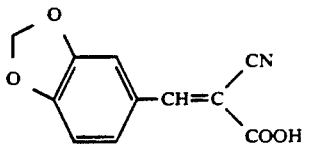

(3)

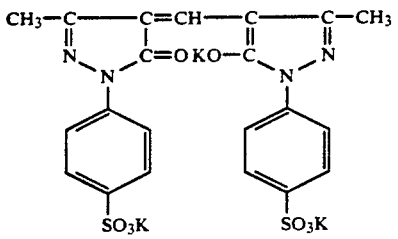

(4)

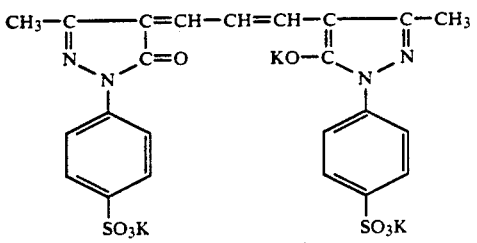

(5)

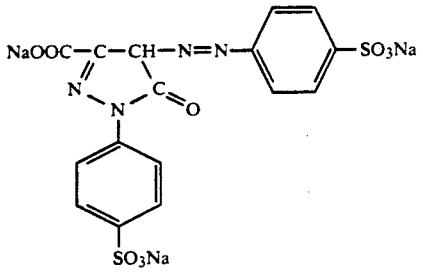

(6)

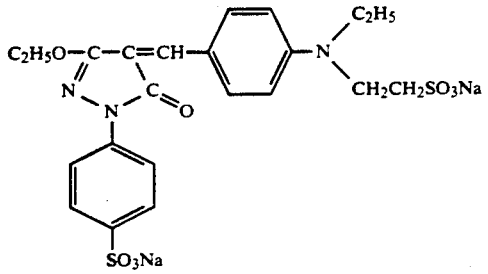

The above mentioned dyes are dissolved in a suitable solvent (for example, water, an alcohol (for example, methanol, ethanol, propanol), acetone or methylcellosolve, or a mixture of such solvents) and added to the coating liquid which is used for a non-photosensitive hydrophilic layer in the present invention.

Gelatin is useful as a binding agent or protective colloid for photographic emulsions, but other hydrophilic colloids can be used for this purpose. For example, gelatin compounds, graft polymers of other polymers with gelatin, and proteins such as albumin and casein for example; cellulose compounds such as hydroxyethylcellulose, carboxymethylcellulose and cellulose sulfate esters for example, sodium alginate, sugar derivatives such as starch derivatives, and many synthetic hydrophilic polymer materials such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, for example, either as homopolymers or as copolymers can be used.

Acid treated gelatin can be used as well as lime treated gelatin, and gelatin hydrolyzates and enzyme degradation products of gelatin can also be used.

The silver halide emulsions used in the method of the present invention may or may not be subjected to chemical sensitization. Sulfur sensitization, reduction sensitization and precious metal sensitization are known as methods for the chemical sensitization of silver halide emulsions, and chemical sensitization can be carried out using these methods either individually or conjointly.

Gold sensitization from among the precious metal sensitization methods is typical, and gold compounds, principally gold complex salts, are used in this case. Complex salts of precious metals other than gold, for example of platinum, palladium or iridium, can also be included. Actual examples have been disclosed, for example, in U.S. Pat. No. 2,448,060 and British Patent 618,061.

As well as the sulfur compounds which are contained in gelatin, various sulfur compounds, for example thiosulfates, thioureas, thiazoles and rhodanines, can be used as sulfur sensitizing agents.

Stannous salts, amines, formamidinsulfinic acid and silane compounds, for example, can be used as reduction sensitizing agents.

Known spectrally sensitizing dyes may be added to the silver halide emulsion layers which are used in the present invention.

Various compounds can be included in the photographic materials of the present invention with a view to preventing the occurrence of fogging during the manufacture, storage or photographic processing of the photosensitive material, or with a view to stabilizing photographic properties. Thus, many compounds which are known as antifogging agents or stabilizers, such as azoles, for example benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione for example; azaindenes, for example triazaindenes, tetra-azaindenes (especially 4-hydroxy substituted (1,3,3a,7)tetraazaindenes) and penta-azaindenes; benzenethiosulfonic acid; benzenesulfinic acid and benzenesulfonic acid amide, for example, can be used for this purpose. Among these compounds, the benzotriazoles (for example, 5-methylbenzotriazole) and nitroindazoles (for example, 5-nitroindazole) are preferred. Furthermore, these compounds can be included in processing baths.

Inorganic or organic film hardening agents can be included in the photographic emulsion layers or other hydrophilic colloid layers in the photographic materials of the present invention. For example, chromium salts (for example chrome alum), aldehydes (for example glutaraldehyde), N-methylol compounds (for example dimethylolurea), dioxane derivatives, active vinyl compounds (for example 1,3,5 -triacryloylhexahydo-s-triazine, 1,3-vinylsulfonyl-2-propanol), active halogen compounds (for example 2,4-dichloro-6-hydroxy-s-triazine), and mucohalogen acids can be used individually or in combinations for this purpose.

A variety of surfactants can be included for various purposes in the photographic emulsion layers or other hydrophilic layers of the photographic materials made using the present invention, being used, for example, as coating promotors or as anti-static agents with a view to improving slip properties, for emulsification and dispersion purposes, for the prevention of sticking and for improving photographic performance (for example, accelerating development, increasing contrast or increasing speed).

For example, use can be made of non-ionic surfactants, such as saponin (steroid based), alkylene oxide derivatives (for example, polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho grups, sulfate ester groups and phosphate ester groups, for example, alkylcarboxylates, alkylsulfonates alkylbenzenesulfonates, alkylnaphthalenesulfonates, alkylsulfate esters, alkylphosphate esters, N-acyl-N-alkyltaurines, sulfosuccinate esters, sulfoalkylpolyoxygethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides, and cationic surfactants, such as alkylamine salts, aliphatic and aromatic quaternary ammonium salts, heterocyclic quaternary ammonium salts, for example pyridinium salts and imidazolium bals, and phosphonium salts and sulfonium salts which contain aliphatic or heterocyclic rings.

The polyalkylene oxides of a molecular weight at least 600 disclosed in JP-B-58-9412 are especially desirable surfactants for use in the present invention. Furthermore, polymer latexes, such as poly(alkyl acrylate) latexes, can be included for providing dimensional stability.

As well as the compounds disclosed, for example, in JP-A-53-77616, JP-A-54-37732, JP-A- 53-137133, JP-A-60-140340 and JP-A-60-14949, various compounds which contain N or S atoms are effective as development accelerators or nucleation infections development accelerators which are suitable for use in this invention.

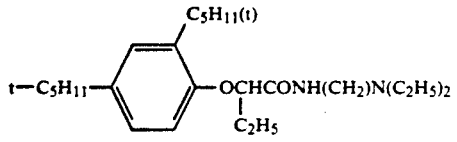

(1)

-continued

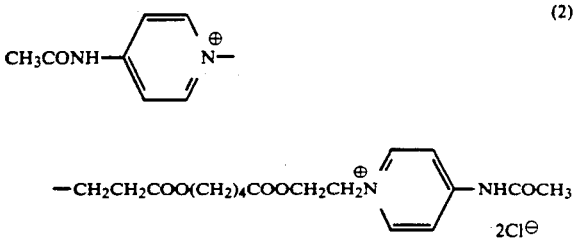

(2)

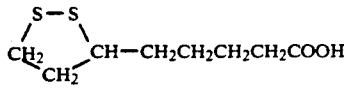

(3)

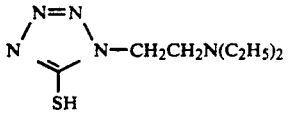

(4)

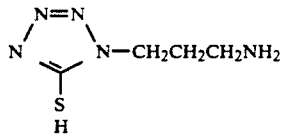

(5)

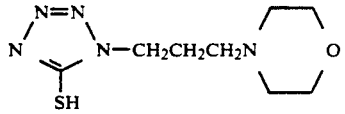

(6)

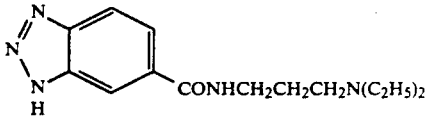

(7)

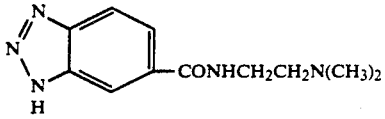

(8)

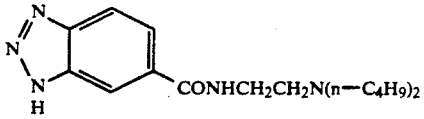

(9)

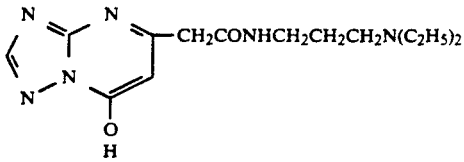

(10)

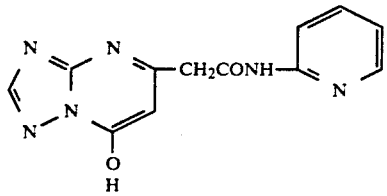

(11)

-continued

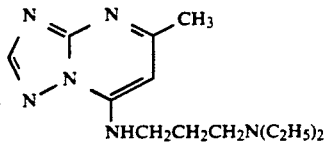

(12)

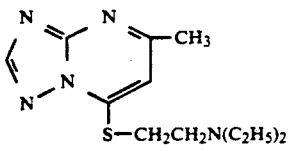

(13)

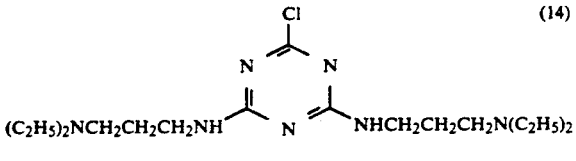

(14)

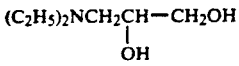

(15)

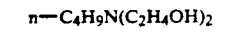

(16)

The appropriate amount of these accelerators differs according to the type of compound, but they are usually added in amounts from $1.0\times10^{-3}$ to 0.5 g/m$^2$, and preferably in amounts from $5.0\times10^{-3}$ to 0.1 g/m$^2$. The accelerators are dissolved in a suitable solvent (for example, water, alcohols such as methanol and ethanol, acetone, dimethylformamide or methylcellosolve) and added to the coating liquid.

A plurality of these additives can be used conjointly.

Stable development baths can be used to obtain ultra-high contrast photographic characteristics using the silver halide photosensitive materials of the present invention, and there is no need for the use of conventional infections developers or the highly alkaline developers of pH approaching 13 disclosed in U.S. Pat. No. 2,419,975.

That is to say, ultra-high contrast negative images can be obtained satisfactorily with the silver halide photosensitive materials of this prevent invention using developers of pH 10.5–12.3, and preferably of pH 11.0–12.0, which contain at least 0.15 mol/liter of sulfite ion as a preservative.

No particular limitation is imposed upon the developing agents which can be used in the method of the present invention, and use can be made, for example, of dihydroxybenzenes (for example hydroquinone), 3-pyrazolidones (for example, 1-phenyl-3-pyrazolidone, 4,4-dimethyl-1-phenyl -3-pyrazolidone), and aminophenols (for example, N-methyl-p -aminophenol), either individually or in combination.

The silver halide photographic materials of the present invention are especially suitable for processing in developers which contain dihydroxybenzenes as the main developing agent and 3-pyrazolidones or aminophenols as auxiliary developing agents. The conjoint use of 0.05 to 0.5 mol/liter of dihydroxybenzenes and not more than 0.06 mol/liter of 3-pyrazolidones or aminophenols in the developer is preferred.

Furthermore, the development rate can be increased and the development time can be shortened by adding amines to the developer, as disclosed in U.S. Pat. No. 4,269,929.

Moreover, pH buffers, such as alkali metal carbonates, borates and phosphates, and development inhibitors or anti-foggants, such as bromides, iodides and organic anti-foggants (nitroindazoles and benzotriazoles are especially desirable) can also be included in the developer. Hard water softening agents, dissolution promotors, toners, development accelerators, surfactants (the aforementioned polyalkylene oxides are especially desirable), anti-foaming agents, film hardening agents, and agents for preventing silver contamination of the film (for example, 2-mercaptobenzimidazolesulfonic acids) can also be included, as required.

The usual compositions can be used for the fixing bath. As well as thiosulfates and thiocyanates, the organosulfur compounds which are known to be effective can be used as fixing agents can also be used as fixing agents. Water soluble aluminum salts, for example, can also be included in the fixing bath as film hardening agents.

The processing temperature in the method of the present invention is normally selected between 18° C. and 50° C.

The use of automatic processors is preferred for photographic processing, and ultra-high contrast negative gradation photographic characteristics can be obtained satisfactorily with the method of the present invention even if the total processing time from the introduction of the photosensitive material into the processor to removing the material from the processor is 90 to 120 seconds.

The compounds disclosed in JP-A-56-24347 can be used in the development baths in the present invention as agents for preventing silver contamination. The compounds disclosed in JP-A-61-267759. can be used as dissolution promotors which are added to the developer. Moreover, the compounds disclosed in JP-A-60-93433 and the compounds disclosed in JP-A-62-186259 can be used as pH buffers in the development baths.

The invention is described in more detail below by means of illustrative examples, which are not limiting.

EXAMPLE 1

Preparation of Polymer Particles which Contain a Redox Compound

A solution comprising 3.0 grams of redox compound (17), 6.0 grams of the polymer illustrative compound P-57 and 50 ml of ethyl acetate was heated to 60° C. Then, the solution was added to 120 ml of an aqueous solution containing 12 grams of gelatin and 0.7 gram of sodium dodecylbenzenesulfonate and a fine particle emulsified dispersion was obtained using a high speed agitator (a homogenizer, manufactured by Nippon Seiki Seisakujo). The ethyl acetate was removed from the emulsion using a rotary evaporator (60° C., approximately 400 Torr for 1 hour).

Preparation of the Photosensitive Emulsion

An aqueous solution of silver nitrate and an aqueous solution of potassium iodide and potassium bromide were added simultaneously over a period of 60 minutes to an aqueous gelatin solution which was being maintained at 50° C. in the presence of $4\times10^{-7}$ mol/mol.Ag of potassium hexachloroiridium(III) while maintaining the pAg value at 7.8. A cubic mono-disperse emulsion of average grain size 0.28 μm and of average silver iodide content 0.3 mol. % was obtained. After de-salting this emulsion using the flocculation method, 40 grams of inactive gelatin was added per mol of silver. Then, the emulsion was added to a solution of $10^{-3}$ mol per mol of silver of KI containing 5,5'-dichloro-9-ethyl-3,3'-bis(3-sulfopropyl)oxacarbocyanine as sensitizing dye while maintaining the emulsion at 50° C., and the temperature was dropped to 10° C. or lower than 10° C. after ageing for 15 minutes.

Preparation of the Coated Samples

The emulsion prepared above was redissolved and the redox compound containing polymer particles also prepared above were added at 40° C. to the emulsion in an amount of $5.7\times10^{-4}$ mol of redox compound per mol of silver halide. Moreover, hydrazine compounds were added, as shown in Table 1, and 5-methylbenzotriazole, 4-hydroxy-1,3,3a,7-tetraazaindene, compounds (a) and (b), 30 wt. % with respect to the gelatin of poly(ethyl acrylate) and the compound (c) indicated below as a gelatin hardening agent were added, and the mixtures were coated on a polyethylene terephthalate film (thickness: 150 μm) having a subbing layer (thickness: 0.5 μm) comprised of vinylidene chloride in an amount of 3.8 g/m² of silver.

COMPARATIVE EXAMPLE 1

The same procedures as described in Example 1 were repeated except that in the preparation of the photosensitive emulsion, the redox compound (17) was added as a 0.6 wt. % solution in methanol in place of the polymer particles containing the redox compound in Example 1. Thus, samples were obtained.

EXAMPLE 2

The same procedures as described in Example 1 were repeated except that redox compound (31) was used in place of redox compound (17) in Example 1. Thus, samples were obtained.

EXAMPLE 3

The same procedures as described in Example 1 were repeated except that redox compound (38) was used in place of redox compound (17) in Example 1. Thus, samples were obtained.

Performance Evaluation

These samples were exposed through a contact screen (150L chain dot type, manufactured by Fuji Photo Film Co.) and an optical wedge using tungsten light of color temperature 3200° k. Then they were developed for 30 seconds at 34° C. in the developer indicated below, fixed, washed and dried.

The results obtained on measuring values of $\overline{G}$, the halftone dot quality and the dot gradation of the samples obtained are as shown in Table 1. The dot gradation was expressed by the following equation:

$\overline{G}$: The gradient of the straight line joining the points of density 0.3 and 3.0 on the characteristic curve. The larger value of $\overline{G}$ indicates the higher contrast in the samples.

Dot Gradation ($\Delta\log E$) = Exposure amount which gave a dot area ratio of 95% ($\log E_{95\%}$) − Exposure amount which gave a dot area ratio of 5% ($\log E_{5\%}$)

The dot quality was assessed visually in five ranks. The five rank evaluation was as follows. The rank "5" indicates the best quality and the rank "5" and "4" can be used as dot originals for plate making, those giving the rank "3" are on the limit for practical use, and those giving the ranks "2" and "1" are of a quality which is of no practical use.

The results obtained are shown in Table 1.

(a)

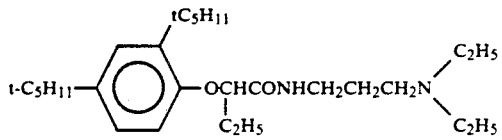

3.5 mg/m²

(b)

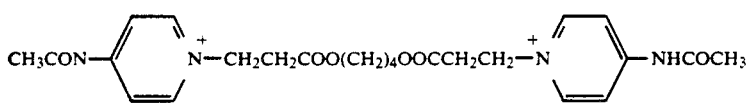

15.0 mg/m²

(c)

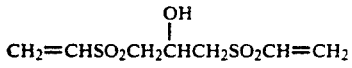

2.0 wt.% with respect to gelatin

Coating of the Protective Layer

A protective layer comprising 1.5 g/m² of gelatin and 0.3 g/m² of polymethyl methacrylate particles (average particle size: 2.5 μm) was coated over these layers using the surfactants indicated below. Thus, samples were obtained.

Surfactants

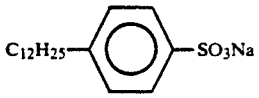

37 mg/m²

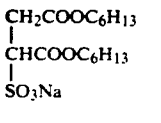

37 mg/m²

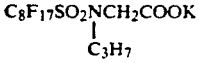

2.5 mg/m²

It is clear that the samples of the present invention had a high $\overline{G}$, a remarkably high contrast, a remarkably wide dot gradation and good dot quality.

| Development Bath | |
|---|---|
| Hydroquinone | 50.0 grams |
| N-Methyl-p-Aminophenol | 0.3 gram |
| Sodium hydroxide | 18.0 grams |
| 5-Sulfosalicylic acid | 55.0 grams |
| Potassium sulfite | 110.0 grams |
| Ethylenediamine tetra-acetic acid di-sodium salt | 1.0 gram |
| Potassium bromide | 10.0 grams |
| 5-Methylbenzotriazole | 0.4 gram |
| 2-Mercaptobenzimidazole-5-sulfonic acid | 0.3 gram |
| Sodium 3-(5-mercaptotetrazole)benzene-sulfonate | 0.2 gram |
| N-n-Butyldiethanolamine | 15.0 grams |
| Sodium toluenesulfonate | 8.0 grams |
| Water to make up to | 1 liter |
| pH adjusted to 11.6 (by adding potassium hydroxide) | pH 11.0 |

TABLE 1

| Sample | Redox Compound | | Hydrazin Compound | | Photographic Property | | |
|---|---|---|---|---|---|---|---|
| | Type | Method of Addition | Type | Amount Added (mol/mol · Ag) | $\overline{G}$ | Dot Gradation | Dot Quality |
| Example 1-1 | (17) | Polymer particles | II-15 | $3.3 \times 10^{-5}$ | 12.5 | 1.42 | 5 |
| Example 1-2 | (17) | Polymer particles | II-19 | $5.0 \times 10^{-5}$ | 13.9 | 1.40 | 5 |
| Example 1-3 | (17) | Polymer particles | II-27 | $3.3 \times 10^{-5}$ | 15.2 | 1.45 | 5 |
| Example 1-4 | (17) | Polymer particles | II-41 | $5.0 \times 10^{-5}$ | 17.1 | 1.46 | 5 |
| Comp. Ex. 1-1 | (17) | Methanol solution | II-19 | $5.0 \times 10^{-5}$ | 11.0 | 1.28 | 4 |
| Comp. Ex. 1-2 | (17) | Methanol solution | II-27 | $3.3 \times 10^{-5}$ | 10.3 | 1.25 | 4 |
| Example 2-1 | (31) | Polymer particles | II-15 | $3.3 \times 10^{-5}$ | 12.8 | 1.40 | 4 |
| Example 2-2 | (31) | Polymer particles | II-19 | $3.3 \times 10^{-5}$ | 14.3 | 1.40 | 5 |
| Example 2-3 | (31) | Polymer particles | II-27 | $3.3 \times 10^{-5}$ | 17.0 | 1.43 | 5 |
| Example 2-4 | (31) | Polymer particles | II-41 | $3.3 \times 10^{-5}$ | 17.8 | 1.44 | 5 |
| Comp. Ex. 2-1 | (31) | Methanol solution | II-19 | $3.3 \times 10^{-5}$ | 11.2 | 1.28 | 4 |
| Comp. Ex. 2-2 | (31) | Methanol solution | II-27 | $3.3 \times 10^{-5}$ | 10.7 | 1.25 | 4 |
| Example 3-1 | (38) | Polymer particles | II-15 | $3.3 \times 10^{-5}$ | 11.5 | 1.40 | 5 |
| Example 3-2 | (38) | Polymer particles | II-19 | $3.3 \times 10^{-5}$ | 12.0 | 1.39 | 5 |
| Example 3-3 | (38) | Polymer particles | II-27 | $3.3 \times 10^{-5}$ | 13.7 | 1.41 | 5 |
| Example 3-4 | (38) | Polymer particles | II-41 | $3.3 \times 10^{-5}$ | 14.0 | 1.42 | 5 |
| Comp. Ex. 3-1 | (38) | Methanol solution | II-19 | $3.3 \times 10^{-5}$ | 10.7 | 1.29 | 4 |
| Comp. Ex. 3-2 | (38) | Methanol solution | II-27 | $3.3 \times 10^{-5}$ | 9.5 | 1.28 | 4 |

EXAMPLE 4

The samples of Examples 1-3 and Comparative Examples 1-3 were subjected to enforced ageing tests.

Enforced Ageing Test Conditions

The samples were stored for 3 days under conditions of 50° C., 30% RH or 50° C., 65% RH and then the photographic property was evaluated in the same way as described in Example 1.

The results obtained were as shown in Table 2.

The photographic sensitivity is indicated by the log value of the exposure required to provide a density of 1.5 (log E), and the difference from the sensitivity without enforced ageing is shown in Table 2.

The samples of the present invention exhibited remarkably little change on enforced ageing and a high level of stability.

TABLE 2

| Sample | Fresh Sample | | Enforced Ageing 50° C., 30% RH, 3 Days | | Enforced Ageing 50° C., 65% RH, 3 Days | |
|---|---|---|---|---|---|---|
| | Sensitivity | $\overline{G}$ | Sensitivity | $\overline{G}$ | Sensitivity | $\overline{G}$ |
| Example 1-1 | Standard | 12.5 | −0.04 | 11.0 | −0.10 | 11.1 |
| Example 1-2 | Standard | 13.9 | −0.05 | 12.1 | −0.10 | 11.5 |
| Example 1-3 | Standard | 15.2 | −0.04 | 14.8 | −0.09 | 12.9 |
| Example 1-4 | Standard | 17.1 | −0.04 | 16.0 | −0.11 | 14.5 |
| Comp. Ex. 1-1 | Standard | 11.0 | −0.18 | 8.5 | −0.29 | 7.3 |
| Comp. Ex. 1-2 | Standard | 10.3 | −0.15 | 7.7 | −0.34 | 5.8 |
| Example 2-1 | Standard | 12.8 | −0.02 | 11.7 | −0.07 | 10.9 |
| Example 2-2 | Standard | 14.3 | −0.03 | 13.9 | −0.08 | 13.0 |
| Example 2-3 | Standard | 17.0 | −0.03 | 16.5 | −0.07 | 14.6 |
| Example 2-4 | Standard | 17.8 | −0.03 | 17.0 | −0.07 | 15.0 |
| Comp. Ex. 2-1 | Standard | 11.2 | −0.12 | 9.1 | −0.19 | 7.6 |
| Comp. Ex. 2-2 | Standard | 10.7 | −0.10 | 8.3 | −0.21 | 7.5 |
| Example 3-1 | Standard | 11.5 | −0.03 | 11.3 | −0.05 | 10.0 |
| Example 3-2 | Standard | 12.0 | −0.02 | 11.8 | −0.05 | 11.2 |
| Example 3-3 | Standard | 13.7 | −0.02 | 13.4 | −0.04 | 12.8 |
| Example 3-4 | Standard | 14.0 | −0.04 | 13.5 | −0.05 | 13.0 |
| Comp. Ex. 3-1 | Standard | 10.7 | −0.09 | 9.3 | −0.13 | 8.0 |
| Comp. Ex. 3-2 | Standard | 9.5 | −0.08 | 8.7 | −0.14 | 7.9 |

The sensitivity after enforced ageing is shown as the change in sensitivity from that observed with a fresh sample.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a hydrophilic colloid layer which contains gelatin wherein said hydrophilic colloid layer contains fine polymer particles which contain a redox compound and a hydrazine compound which is not the same as the redox compound is contained in said hydrophilic colloid layer and/or in another hydrophilic colloid layer, wherein the redox compound is represented by general formula (I) indicated below:

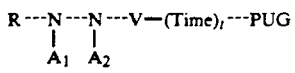

(I)

wherein both $A_1$ and $A_2$ represent hydrogen atoms, or one represents a hydrogen atom and the other represents a substituted or unsubstituted alkylsulfonyl group, a substituted or unsubstituted arylsulfonyl group, or

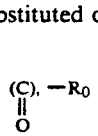

(wherein $R_0$ represents an alkyl group, an alkenyl group, an aryl group, an alkoxy group or an aryloxy group, and l represents 1 or 2); Time represents a divalent linking group, and t represents 0 or 1; PUG represents a development inhibitor; V represents a carbonyl group,

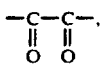

a sulfonyl group, a sulfoxy group,

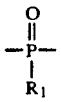

(where $R_1$ represents an alkoxy group or an aryloxy group), an iminomethylene group or a thiocarbonyl group; and R represents an aliphatic group, an aromatic group or a heterocyclic group.

2. A silver halide photographic material of claim 1, wherein the hydrazine compound is represented by general formula (II) indicated below:

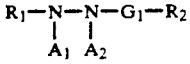

(II)

wherein $R_1$ represents an aliphatic group or an aromatic group, $R_2$ represents a hydrogen atom, an alkyl group, an aryl group, an alkoxy group, an aryloxy group, an amino group, a carbamoyl group or an oxycarbonyl group, $G_1$ represents a carbonyl group, a sulfonyl group, a sulfoxy group, a

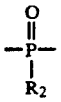

group (where $R_2$ is as defined above) or an iminomethylene group, and $A_1$ and $A_2$ both represent hydrogen atoms, or one represents a hydrogen atom and the other represents a substituted or unsubstituted alkylsulfonyl group, a substituted or unsubstituted arylsulfonyl group or a substituted or unsubstituted acyl group.

3. A silver halide photographic material of claim 1, wherein the fine polymer particles are vinyl polymers.

4. A silver halide photographic material of claim 1, wherein the fine polymer particles are polymers obtained by condensation polymerization.

5. A silver halide photographic material of claim 1, wherein the fine polymer particles are polymers obtained by poly-addition reaction.

6. A silver halide photographic material of claim 1, wherein the fine polymer particles are cellulose compounds.

7. A silver halide photographic material of claim 1, wherein the redox compound is used in an amount of from $1.0\times10^{-6}$ to $5.0\times10^{-2}$ mol per mol silver.

8. A silver halide photograhic material of claim 1, wherein the polymer for the fine polymer particles is used in an amount of from 10 to 400 percent by weight with respect to the redox compound.

9. A silver halide photographic material of claim 1, wherein the hydrazine compound is used in an amount of from $1\times10^{-6}$ to $1\times10^{-1}$ mol per mole of silver halide.

* * * * *

UNITED STATES PATENT AND TRADEMARK OFFICE

CERTIFICATE OF CORRECTION

PATENT NO. : 5,085,971
DATED : February 4, 1992
INVENTOR(S) : Kazunobu Katch, et. al.

It is certified that error appears in the above-indentified patent and that said Letters Patent is hereby corrected as shown below:

Column 42, line 61, delete "carbamoyl" and insert therefor --carbonyl--.

Signed and Sealed this

First Day of November, 1994

*Attest:*

*Attesting Officer*

Bruce Lehman

BRUCE LEHMAN

*Commissioner of Patents and Trademarks*